US006940992B2

(12) United States Patent
Stiles

(10) Patent No.: US 6,940,992 B2
(45) Date of Patent: Sep. 6, 2005

(54) PUSH-PUSH MULTIPLE MAGNETIC AIR GAP TRANSDUCER

(75) Inventor: Enrique M. Stiles, Imperial Beach, CA (US)

(73) Assignee: Step Technologies Inc., Minneapolis, MN (US)

( * ) Notice: Subject to any disclaimer, the term of this patent is extended or adjusted under 35 U.S.C. 154(b) by 213 days.

(21) Appl. No.: 10/289,080

(22) Filed: Nov. 5, 2002

(65) Prior Publication Data

US 2004/0086145 A1 May 6, 2004

(51) Int. Cl.[7] ..... H04R 25/00
(52) U.S. Cl. ..... 381/412; 381/414; 381/421
(58) Field of Search ..... 381/412, 414, 381/416, 419, 420, 421, 422, 400, 413, 401, 402, 96

(56) References Cited

U.S. PATENT DOCUMENTS 4,492,827 A * 1/1985 Shintaku ..... 381/422
4,783,824 A 11/1988 Kobayashi
5,461,677 A * 10/1995 Raj et al. ..... 381/422
5,687,248 A 11/1997 Yen et al.
5,740,265 A 4/1998 Shirakawa
6,671,385 B2 12/2003 Suzuki et al.
2003/0133587 A1 7/2003 Hyre et al.
2003/0152246 A1 8/2003 Tanabe

FOREIGN PATENT DOCUMENTS

JP 05-122792 5/1993

* cited by examiner

*Primary Examiner*—Huyen Le
(74) *Attorney, Agent, or Firm*—Richard Calderwood

(57) ABSTRACT

An electromagnetic transducer, such as an audio speaker, includes a return path member which is a pole piece for external magnet geometries or a cup for internal magnet geometries. The magnetic flux return path for the primary drive magnet is through a first portion of the return path member. A first section of a low reluctance magnetic flux return path for a secondary drive magnet is through a second portion of the return path member. A magnetically conductive plate provides a second section of the low reluctance return path from the second portion of the return path member to the secondary drive magnet.

43 Claims, 23 Drawing Sheets

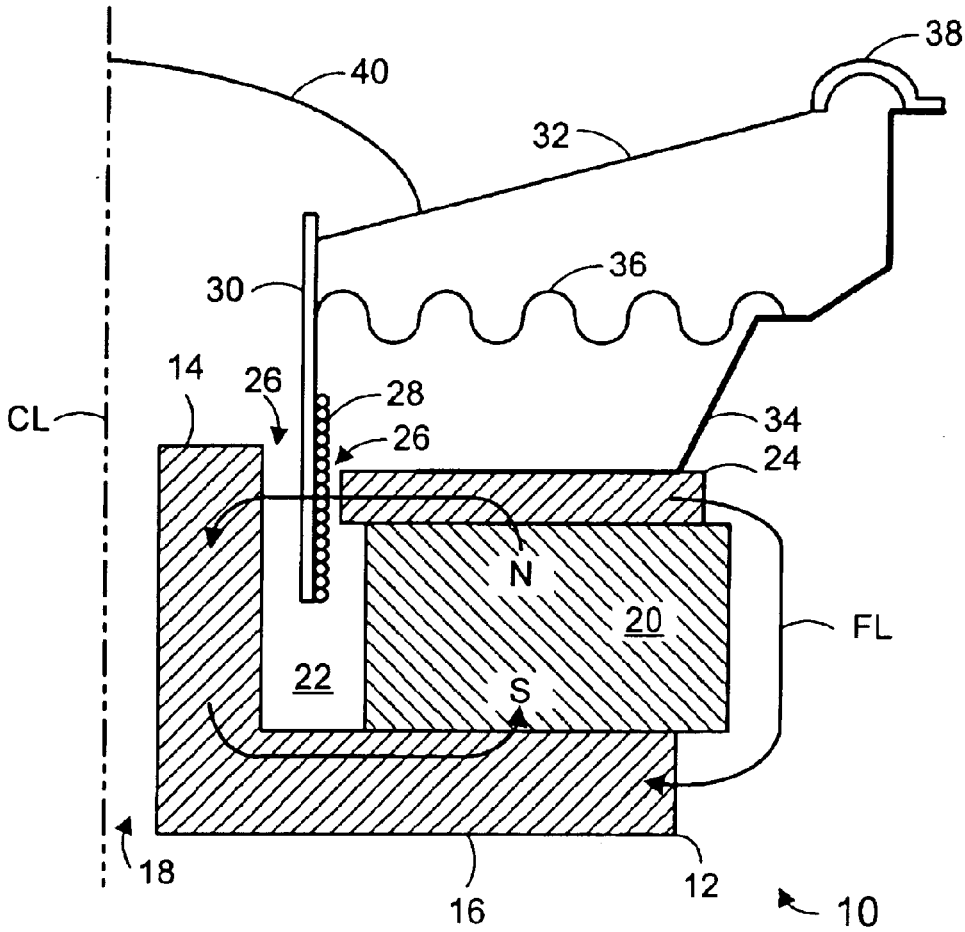
Fig. 1A - prior art

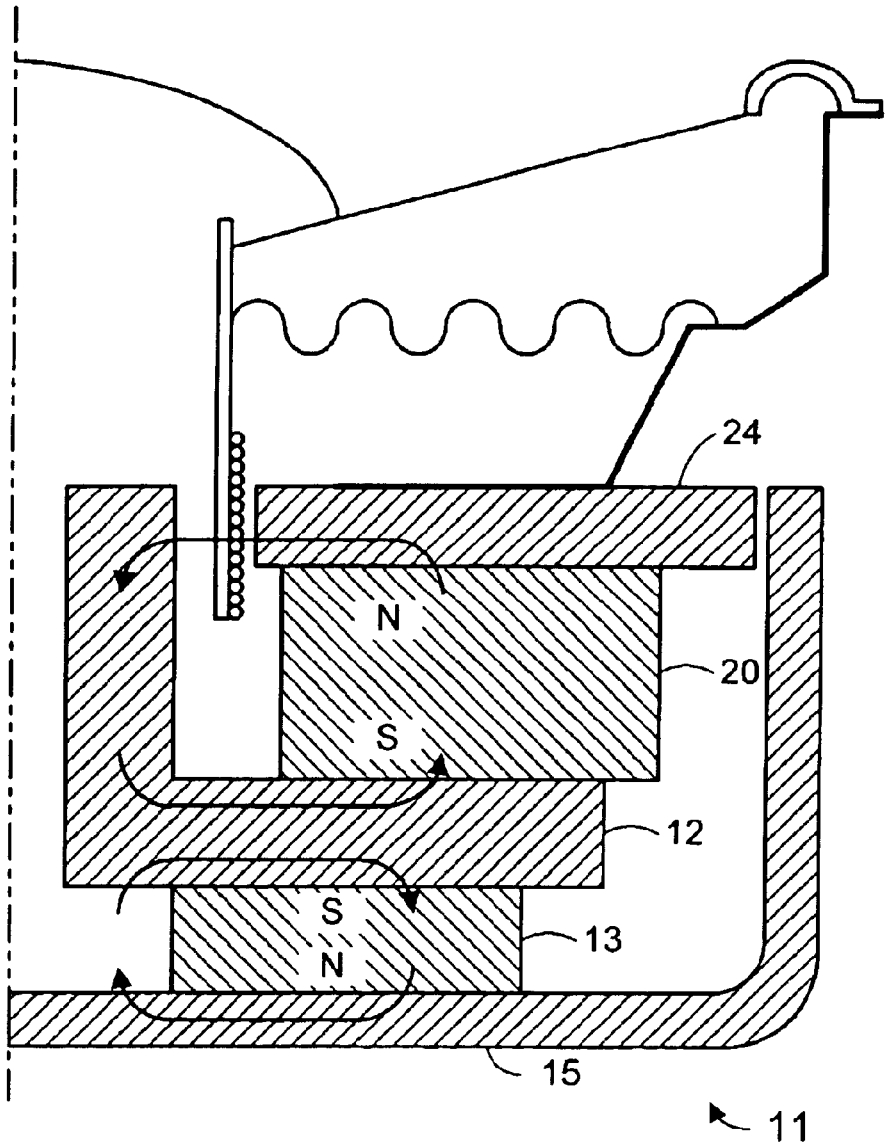
Fig. 1B - prior art

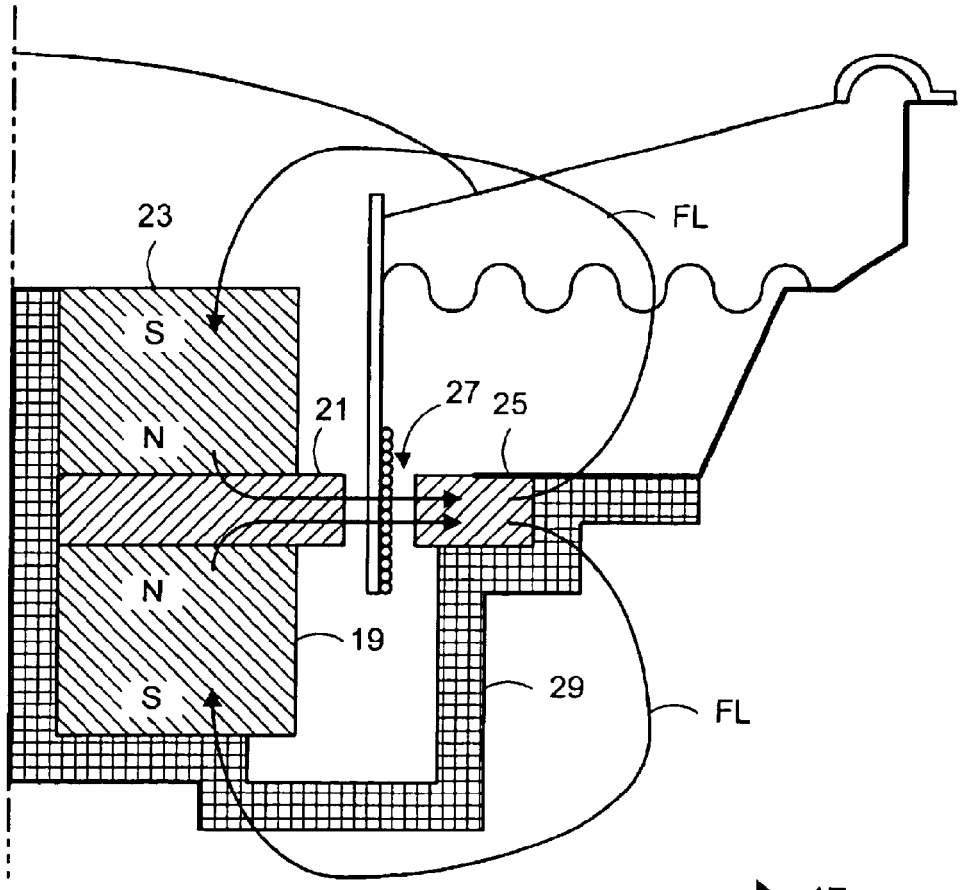
Fig. 1C - prior art

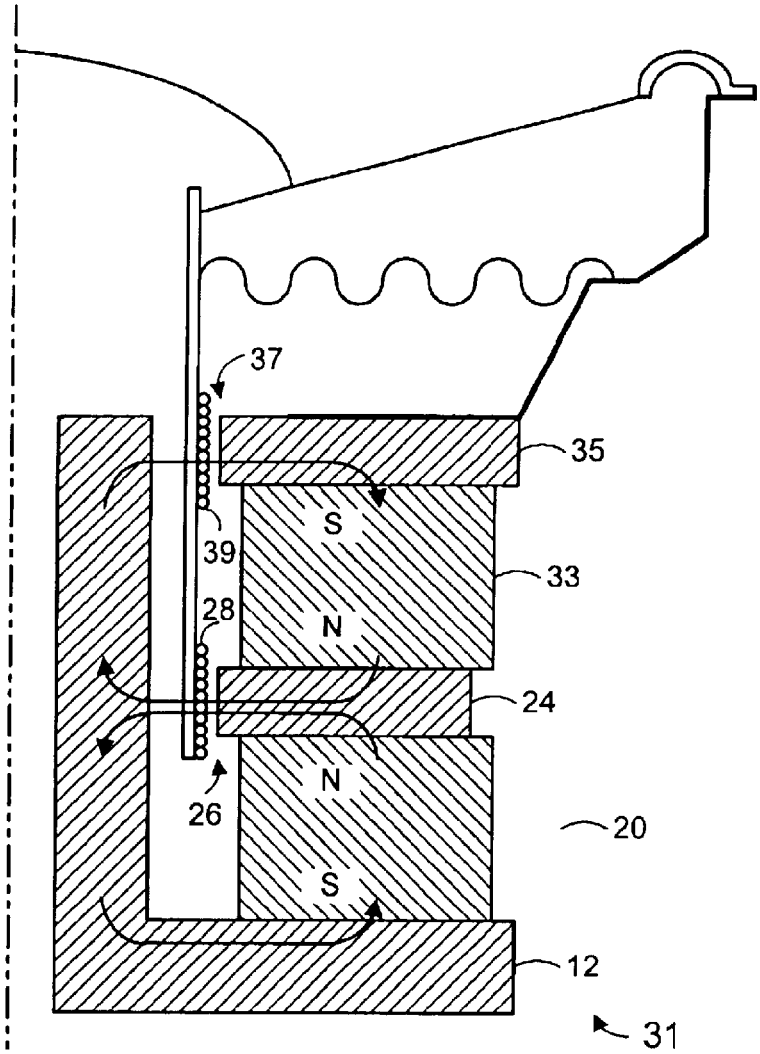
Fig. 1D - prior art

110

120

220

230

PUSH-PUSH MULTIPLE MAGNETIC AIR GAP TRANSDUCER

RELATED APPLICATION

This application is related to a co-pending application entitled "Push-Push Multiple Magnetic Air Gap Transducer" by this inventor.

BACKGROUND OF THE INVENTION

1. Technical Field of the Invention

This invention relates generally to electromagnetic transducers such as audio speakers, and more specifically to a geometry having a low reluctance return path for magnetic flux from a secondary drive magnet.

2. Background Art

Speakers are shown in cross-section in this document. Because speakers are generally cylindrically or rotationally symmetrical about an axis line or center line, only one side of any given speaker is shown, but the skilled reader will readily appreciate the three-dimensional structure which is thus represented. The reader will appreciate, however, that the invention is not limited to such axially symmetric implementations.

FIG. 1A illustrates a conventional audio speaker 10 such as is known in the prior art, shown as symmetrical about a center line CL. The speaker includes a magnetically conductive pole plate 12 which includes a pole 14 which may be either coupled to or integral with the base 16 of the pole plate, as shown. The pole may include an axial hole 18 for permitting airflow to cool the motor structure and depressurize the diaphragm assembly. A ring-shaped permanent magnet 20 surrounds the pole, with a cavity 22 between them. A magnetically conductive top plate 24 surrounds the pole, with a magnetic air gap 26 between them. Typically, the magnetic air gap will be smaller than the cavity. The pole plate, magnet, and top plate may collectively be termed a magnet assembly or a motor structure. The heavy black arrows denote exemplary directions of flux flow, throughout this document; the skilled reader will readily appreciate that the magnets may be reversed, and the flux will flow the opposite direction, and the transducer will operate correctly, especially when provided with an inverse phase electrical input signal.

An electrically conductive voice coil 28 is rigidly attached to a cylindrical bobbin or voice coil former 30. The voice coil is suspended within the magnetic air gap to provide mechanical force to a diaphragm 32 which is coupled to the bobbin. When an alternating current is passed through the voice coil, the voice coil moves up and down in the air gap along the axis of the speaker, causing the diaphragm to generate sound waves.

A frame 34 is coupled to the magnet assembly. There are two suspension components. A damper or spider 36 is coupled to the bobbin and the frame, and a surround 38 is coupled to the diaphragm and the frame. These two suspension components serve to keep the bobbin and diaphragm centered and aligned with respect to the pole, while allowing axial movement. A dust cap 40 seals the assembly and protects against infiltration of dust particles and other stray materials which might contaminate the magnetic air gap and thereby interfere with the operation or quality of the speaker.

When, as shown, the voice coil is taller (along the axis) than the magnetic air gap, the speaker is said to have an "overhung" geometry. If, on the other hand, the voice coil were shorter than the magnetic air gap, the speaker would be "underhung".

If the voice coil moves so far that there exists a different number of voice coil turns within the air gap (i.e. an overhung voice coil has moved so far that one end of it has entered the air gap, or an underhung voice coil has moved so far that one end of it has left the air gap), the speaker begins to exhibit nonlinear characteristics, and the sound quality is distorted or changed. This is especially problematic when playing low frequency sounds at high volume, which require maximum voice coil travel.

The common approach to solving this problem has been to use highly overhung or highly underhung geometries to achieve a high degree of linear voice coil travel. These approaches have inherent limitations, however. The highly overhung motor requires increasingly longer coils, which in turn increases the total moving mass of the diaphragm assembly. At some point, this ever-increasing mass becomes so great that the inherent mechanical design limits are reached, which prevents any further controllable increase in excursion. At the same time, increasing the voice coil mass with no resultant increase in utilized magnetic flux will reduce the overall efficiency of the transducer. Efficiency is proportional to BL squared, and inversely proportional to mass squared. In the highly underhung geometry, other practical limits are reached because of the relative increase in magnet area required to maintain a constant B across the magnetic gap height in order to achieve higher linear excursions without sacrificing efficiency. Unfortunately, this increase in available magnetic flux, B, does not result in an increase in BL, and therefore the transducer's efficiency also does not increase.

One hybrid approach has been to provide the bobbin with two tandem voice coils which travel in two respective magnetic air gaps, such as is taught in U.S. Pat. Nos. 4,783,824 to Kobayashi and 5,740,265 to Shirakawa. These are both "push-pull" geometries, in which the magnetic flux over the top magnetic air gap travels in the opposite direction as the flux over the bottom magnetic air gap; this requires that the two voice coils be wound in opposite directions, and it requires twice the total voice coil length and a longer bobbin without increasing the total linear excursion, all of which add manufacturing cost with minimal benefit. Kobayashi further teaches that the voice coils may be wound in the same direction if the currents through them are of opposite phases. Unfortunately, this requires each voice coil to have its own, dedicated pair of electrical inputs, which further increase the complexity and cost of the transducer.

In the prior art overhung speakers, 100% of the magnetic air gap is always active during linear operation. In the prior art underhung speakers, 100% of the voice coil windings are always active during linear operation.

Speakers may generally be classified as having an external magnet geometry (in which ring magnets surround a pole plate) or an internal magnet geometry (in which a cup contains magnets). Pole plates and cups may collectively be termed magnetic return path members or yokes, as they serve as the return path for magnetic flux which has crossed over the magnetic air gap.

Materials may be classified as either magnetic materials or non-magnetic materials. Non-magnetic materials may also be termed non magnetically conductive materials; aluminum and chalk are examples of non-magnetic materials. Magnetic materials are classified as hard magnetic materials and soft magnetic materials. Hard magnetic materials are also called permanent magnets, and generate magnetic flux fields without outside causation. Soft magnetic materials are those which, although not permanent magnets, will themselves become magnetized and generate flux in response to their being placed in a magnetic field. Soft magnetic materials include the ferrous metals such as steel and iron.

One problem with the prior art geometries is leaking magnetic flux (denoted FL).

FIG. 1B illustrates a shielded speaker 11 which includes a pole plate 12, a primary magnet 20, a primary plate 24, and other components as shown in FIG. 1A, with an additional shielding or bucking magnet 13. The bucking magnet is located on the opposite side of the pole plate from the magnet assembly, and serves to buck or cancel out the leaking flux. A shield 15 encloses the magnet assembly and the bucking magnet, and further reduces flux leakage.

FIG. 1C illustrates the speaker 17 taught in U.S. Pat. No. 5,550,332 to Sakamoto. The speaker includes a primary drive magnet 19, a drive plate 21, a bucking magnet 23, and a magnetically conductive outer ring 25. The drive plate and outer ring define a magnetic air gap 27. The bucking magnet is positioned on the opposite side of the drive plate from the primary magnet, and is oriented with its polarity opposite that of the primary magnet. In this geometry, the bucking magnet is not used to reduce flux leakage (and, in fact, it increases flux leakage)—it is used to increase flux density over the magnetic air gap. The magnet assembly components are held in place by a non-magnetically-conductive holder 29. The magnetic flux return paths from the outer ring to both magnets are solely via leakage flux FL.

FIG. 1D illustrates the speaker 31 taught in U.S. Pat. No. 4,783,824 to Kobayashi. The speaker includes a pole piece 12, a primary drive magnet 20, a first drive plate 24, and a diaphragm assembly substantially as in FIG. 1A. A bucking magnet 33 is positioned on the opposite side of the primary drive plate, with its poles oriented opposite those of the primary drive magnet, as in Sakamoto. Rather than relying on high reluctance air return paths for the magnetic flux from the primary drive plate to the respective magnets, Kobayashi adds a second drive plate 35 which defines a second drive magnetic air gap 37, in which Kobayashi places a second voice coil 39. The Kobayashi speaker is thus a "push-pull" geometry, with the respective voice coils either wound in opposite directions or driven with opposite-phase alternating current electrical signals.

What is needed is a speaker geometry which provides a low reluctance return path for flux to the bucking magnet, without requiring a push-pull voice coil arrangement.

BRIEF DESCRIPTION OF THE DRAWINGS

The invention will be understood more fully from the detailed description given below and from the accompanying drawings of embodiments of the invention which, however, should not be taken to limit the invention to the specific embodiments described, but are for explanation and understanding only.

FIGS. 1A–D show, in cross-section, speaker geometries according to the prior art.

DETAILED DESCRIPTION

The invention may be utilized in a variety of magnetic transducer applications, including but not limited to audio speakers, microphones, mechanical position sensors, actuators (which can be linear motors), and the like. For the sake of convenience, the invention will be described with reference to audio speaker embodiments, but this should be considered illustrative and not limiting. The invention may prove especially useful in high ("large") excursion applications such as subwoofer speakers, but, again, this should not be considered limiting.

This invention permits the simultaneous utilization of less than 100% of the magnetic air gap and less than 100% of the voice coil windings. For example, this invention allows optimum linear excursion to be achieved with the simultaneous utilization of 50% of the voice coil windings and 33% of the magnetic gap, or as another example, 66% of the magnetic gap and 33% of the voice coil windings could be obtained. A multitude of ratios are possible. This allows the designer to achieve a desired balance between, or combination of: high frequency extension, low frequency extension and enclosure volume, efficiency, linear excursion, cost, power handling, and size of the motor structure. The designer can now achieve a much broader range of combinations than were previously attainable.

Figure 2A:
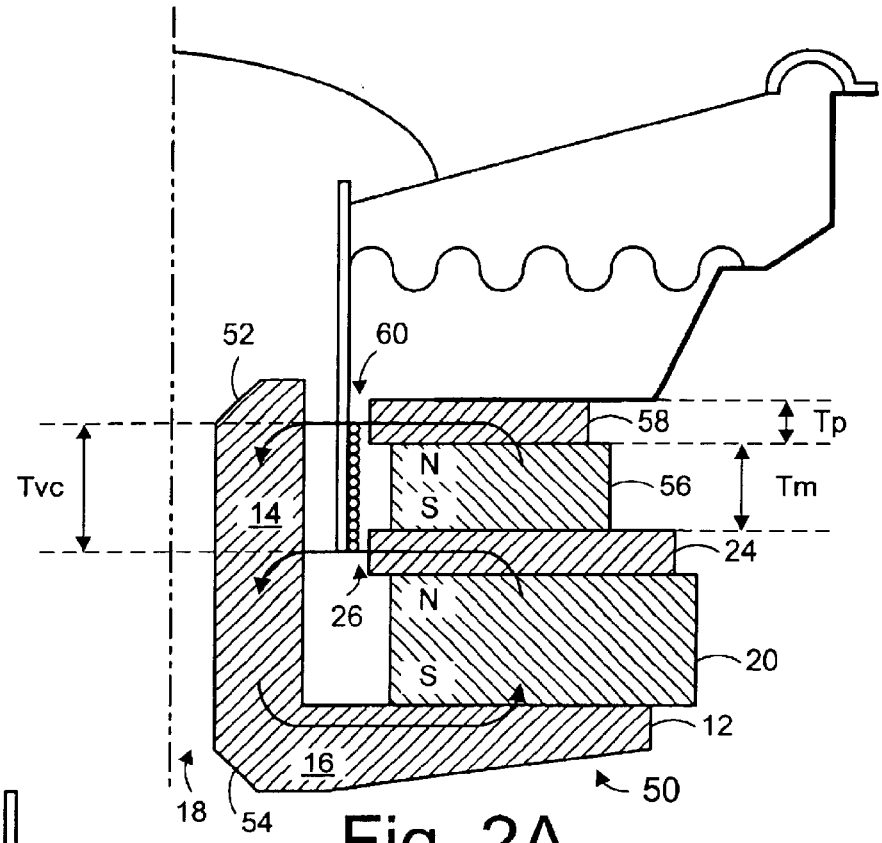
FIGS. 2A–C show, in cross-section, one embodiment of a speaker geometry according to this invention, having one voice coil and having two air gaps over which the magnetic flux is in the same direction.

FIG. 2A illustrates one embodiment of a speaker 50 according to this invention. The speaker includes a pole plate 12 including a back plate 16 and a pole piece 14 which can be either integral with or coupled to the back plate. In some embodiments, there may be a hole 18 extending through the length of the pole piece to permit air flow in response to the bellows action of the speaker. In some embodiments, it may be advantageous to adapt this hole with beveled ends 52, 54, for improved aerodynamic performance with less turbulence, allowing the use of a smaller hole or vent without causing too much distortion. If the vent is made too large, the magnetic efficiency is reduced, because of the reduced quantity of steel in the pole, which in turn could lead to magnetic saturation of the steel.

The magnet assembly includes a first permanent magnet 20, first plate 24, and first magnetic air gap 26 as in the prior art. The invention further includes a magnetic material member 56 which may, in some embodiments, be a second permanent magnet. Unlike in the prior art dual gap speakers, the magnetic material member is oriented with its flux in the same direction as the first magnet, or, in other words, such that the first magnet 20 and the magnetic material member 56 have opposite poles facing each other. The speaker further includes a second plate 58 which defines a second magnetic air gap 60.

The frame and the diaphragm assembly including the bobbin or tube, diaphragm, spider, surround, and dust cover may be substantially as known in the prior art. The voice coil, first plate, second magnet, and second plate may advantageously be sized such that the voice coil extends from the center of one plate to the center of the other plate. The voice coil may advantageously have a height Tvc which is substantially equal to the height Tm of the second magnet plus the height Tp of the second plate (which in most instances should be the same height as the first plate so the two air gaps are of equal height). In order to travel into a nonlinear response region, the voice coil would have to travel so far as to have its bottom end enter the upper second air gap, or its top end enter the lower first air gap. This gives the voice coil a peak-to-peak linear travel equal to the height (thickness) Tp of the upper top plate plus twice the height Tm of the space between the magnetic air gaps. In an optimized configuration, the two plates are of equal thickness, and the second magnet 56 should be at least as thick as either of the plates.

The relative sizes of the magnets, plates, pole plate, and pole piece can be determined according to the specific requirements of a particular application, and are well within the abilities of ordinary skilled speaker designers, once armed with the teachings of this patent. For example, it may often be the case that the lower magnet will need to be larger (or, more to the point, more powerful) than the upper magnet, in order to have equal flux through the two air gaps, because the lower plate, between the magnets, will shunt some percentage of the lower magnet's flux directly into the upper magnet rather than through the first air gap.

Figure 2B:
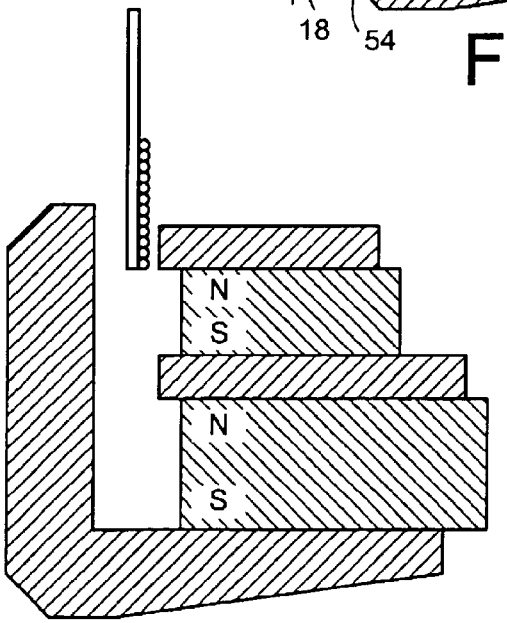
Figure 2C:
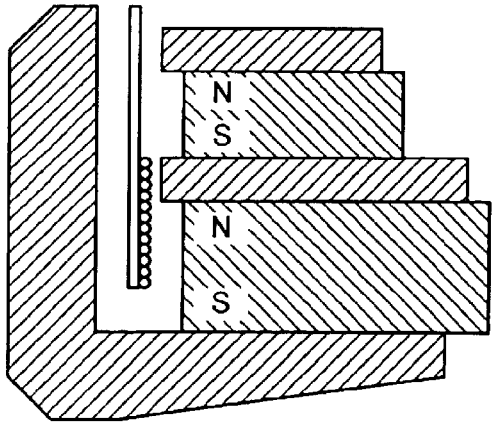

FIGS. 2B and 2C illustrate the embodiment of FIG. 2A with the voice coil at the points of maximum extension and retraction, respectively, in the region of linear excursion (Xmax). The reader should note that in all three FIGS. 2A–C, there is an equivalent of one magnetic air gap active (100% of the top magnetic air gap in FIG. 2B, 50% of each of the two magnetic air gaps in FIG. 2A, and 100% of the bottom magnetic air gap in FIG. 2C), and a total of one magnetic air gap's height of voice coil windings active. At any given point in the linear excursion realm, 50% of the total available magnetic air gap is active, with a corresponding length of voice coil, which is equal to Tvc minus Tm.

Figure 3A:
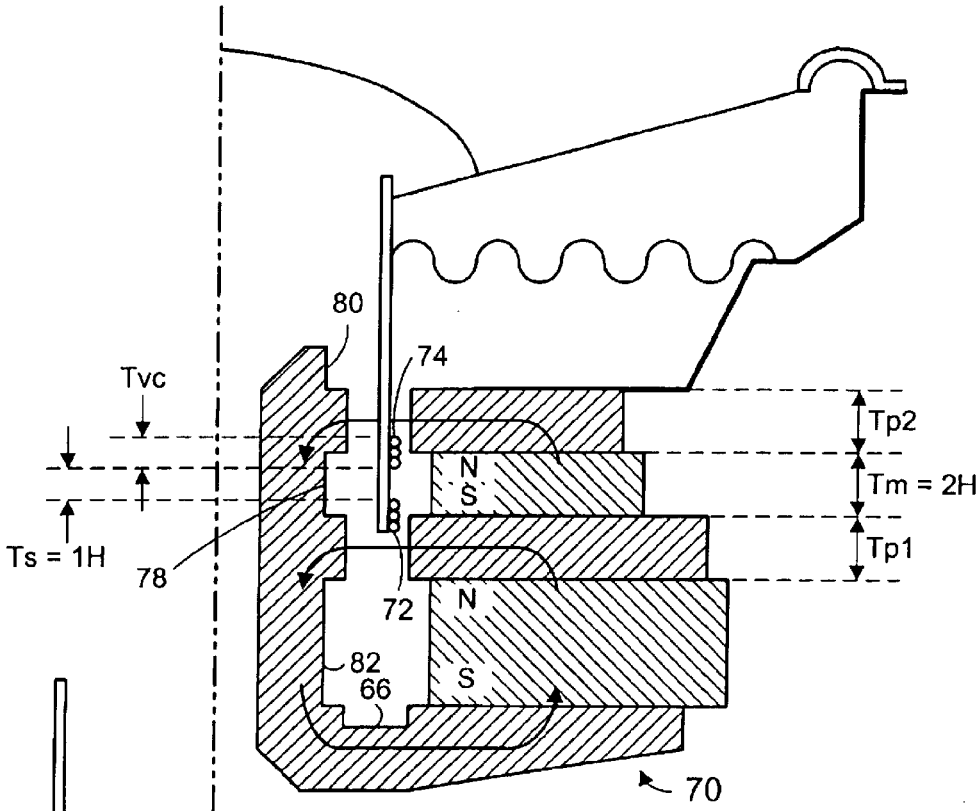
FIGS. 3A–C show, in cross-section, a second embodiment of a speaker, having two same direction magnetic flux air gaps and two tandem voice coils.

FIG. 3A illustrates a second embodiment of a speaker geometry 70 according to this invention, which is similar to the first embodiment except that it includes two voice coils 72, 74. Ideally, the two voice coils should be of the same height, and the distance from the center of one to the center of the other should equal the distance between the two air gaps (or, in other words, the thickness of the magnetic material member which is between their respective plates). In the optimum configuration with optimized linearity, the space between the two plates and each of the two plates should be of equal thickness, and this thickness should be the same as the height, Tvc, of one of the voice coils plus the space, Ts, between the voice coils, so that when, for example, the top voice coil is just beginning to exit the top of the top magnetic air gap during extension, the bottom voice coil will be just beginning to enter the top magnetic air gap.

Figure 3B:
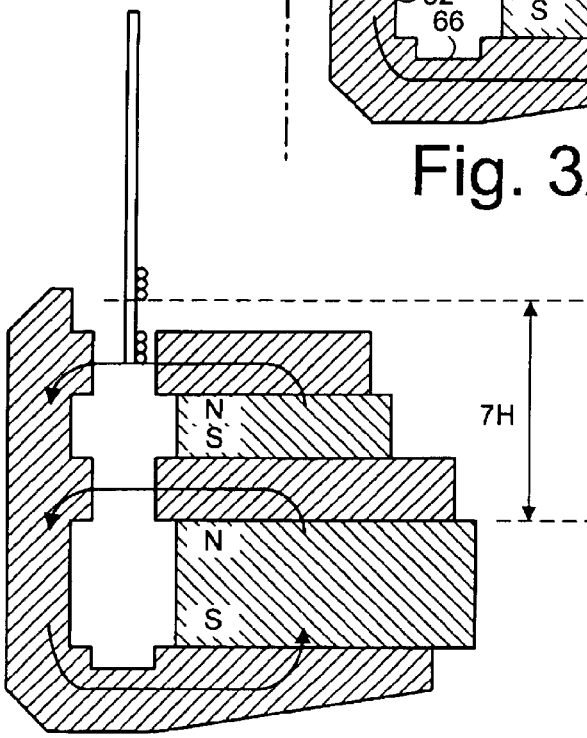
Figure 3C:
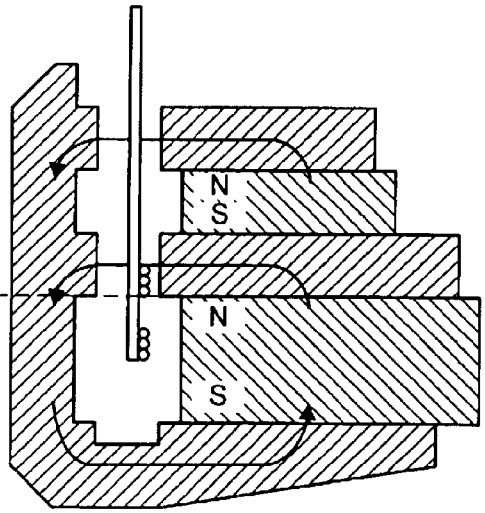

FIGS. 3A–C illustrate one very optimized embodiment, in which the height Tvc of each voice coil is a distance H, the height Tp1, Tp2 of each magnetic air gap is a distance 2H, and the distance Tm between the magnetic air gaps is 2H. Note that Ts=H=Tvc. This geometry gives a linear peak-to-peak excursion of 7H; at one extreme, the top edge of the bottom voice coil is even with the top of the top magnetic air gap, and at the other extreme, the bottom edge of the top voice coil is even with the bottom of the bottom magnetic air gap.

In one embodiment, the voice coils are wound in the same direction, and the electrical signal is applied to them in the same polarity. In another embodiment, the voice coils are wound in opposite directions, and they receive opposite polarity electrical signals.

Optionally, the pole plate may be adapted with a groove 66 into which the voice coil bobbin may extend at its maximum downward excursion, preventing the bobbin from striking the pole plate, which would grossly distort the sound and possibly damage the bobbin or voice coil and/or other components. This is taught in U.S. Pat. No. 5,715,324 to Tanabe et al.

In one mode, the pole piece may be adapted with a groove 78 substantially opposite the spacer or magnet between the air gaps, a groove 80 above the upper magnetic air gap, and a groove 82 below the lower magnetic air gap, to further improve linearity by concentrating more of the flux into the air gaps and creating symmetrical fringing fields above and below the edges of each air gap.

The reader should note that, in all three FIGS. 3A–C, there are 50% of the total available voice coil windings active in magnetic air gap(s), and 25% of the total available magnetic air gap is being used, during linear operation of the transducer.

Figure 4:
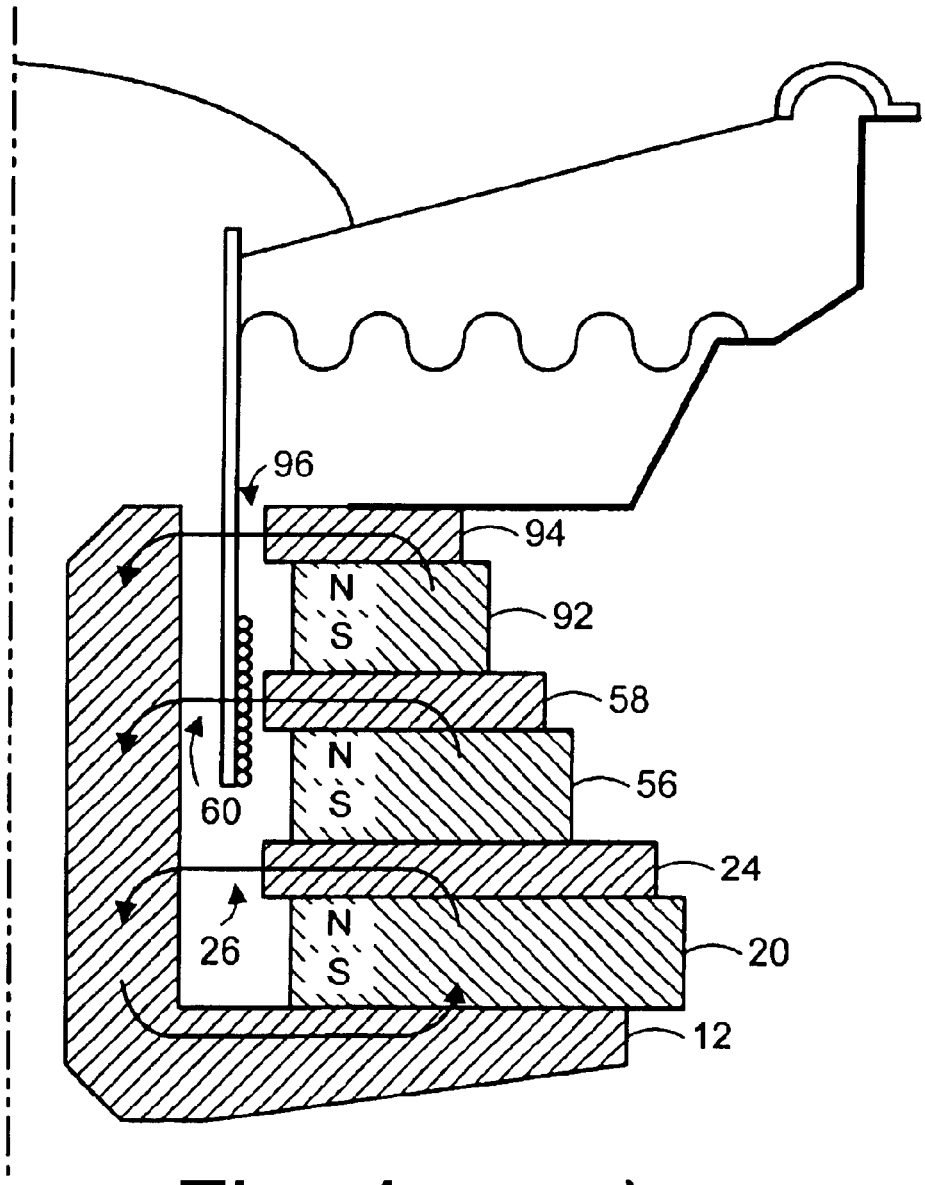
FIG. 4 shows, in cross-section, a third embodiment of a speaker geometry, having three air gaps and one voice coil.

FIG. 4 illustrates a third embodiment of a speaker geometry 90 according to this invention. The speaker includes a pole plate 12, first magnet 20, first plate 24, magnetic material member 56, second plate 58, and other components generally similar to those of the first embodiment. The speaker further includes a top magnetic material member 92 and a third plate 94 to define a third magnetic air gap 96. By including three or more air gaps, the total linear excursion of the voice coil can be made very large. By utilizing plates of the same thickness, and magnets of the same thickness (which may or may not be the same as the thickness of the plates, if a single voice coil is used), and by appropriately sizing the diameters of the magnets and plates, the flux density can be made substantially equal over each of the gaps, which results in optimum linearity over the entire range of linear voice coil travel. Selection of the particular thicknesses and diameters is well within the ordinary skill of those in this field armed with the previous discussion, and need not be discussed in detail here.

FIGS. 5A–F illustrate a fourth embodiment of a speaker geometry 100 which is similar to that of FIG. 4. The speaker includes pole plate 12, primary magnet 20, first gap plate 24, magnetic material member 56, second gap plate 58, magnetic material member 92, third gap plate 94, and bobbin 30, as well as the rest of the diaphragm assembly (not shown). The speaker further includes a voice coil 102 which extends from the center of the top magnetic air gap to the center of the bottom magnetic air gap, as shown. The speaker may optionally include a magnetically conductive spacer 104, if the primary magnet is not sufficiently thick to allow clearance for full voice coil travel.

Figure 5A:
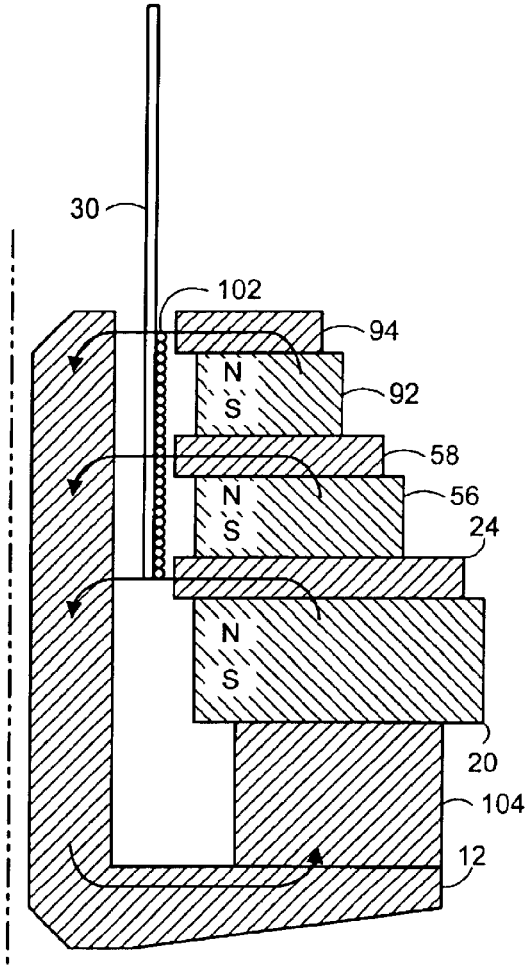
FIGS. 5A–F show, in cross-section, a fourth embodiment of a speaker geometry, having three air gaps and a single voice coil.
Figure 5B:
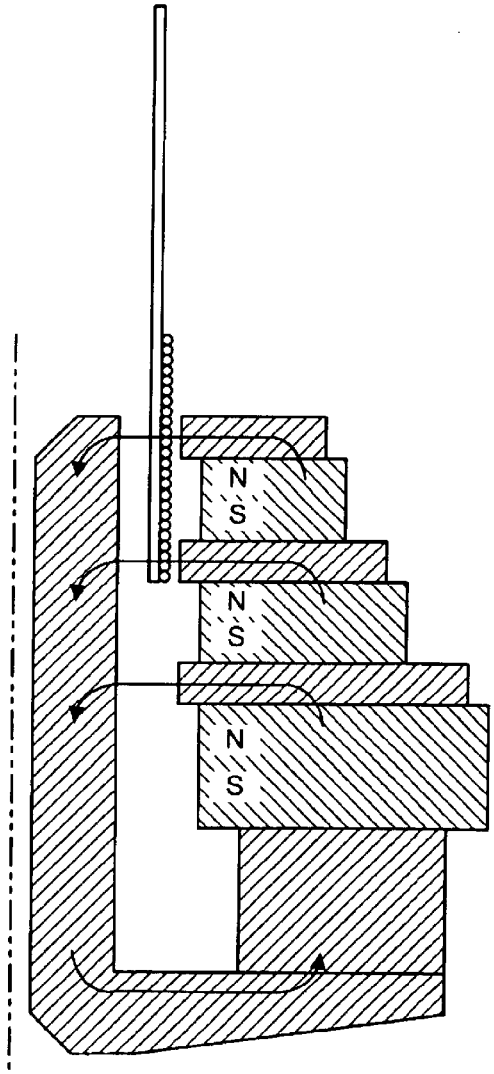
Figure 5C:
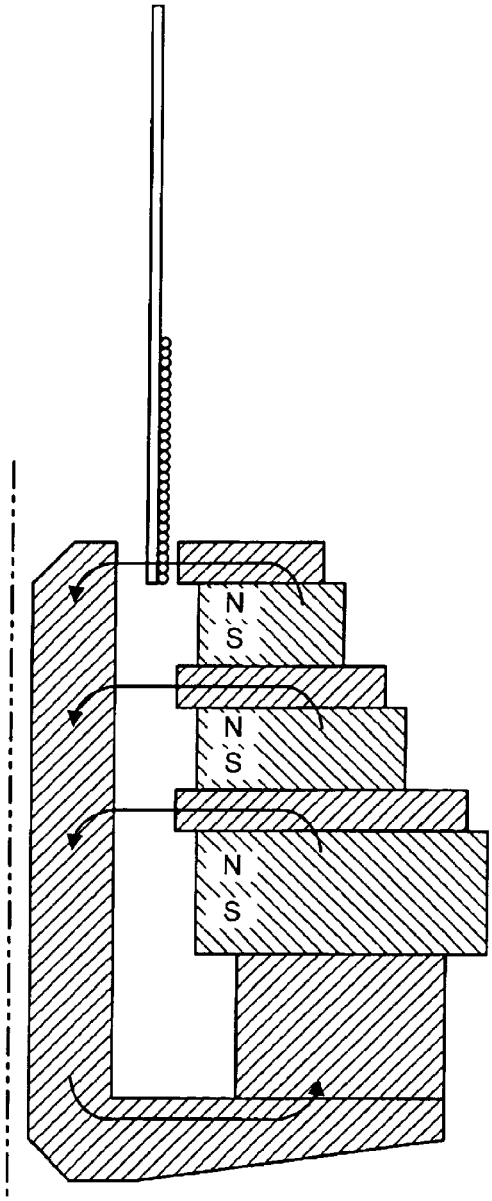
Figure 5D:
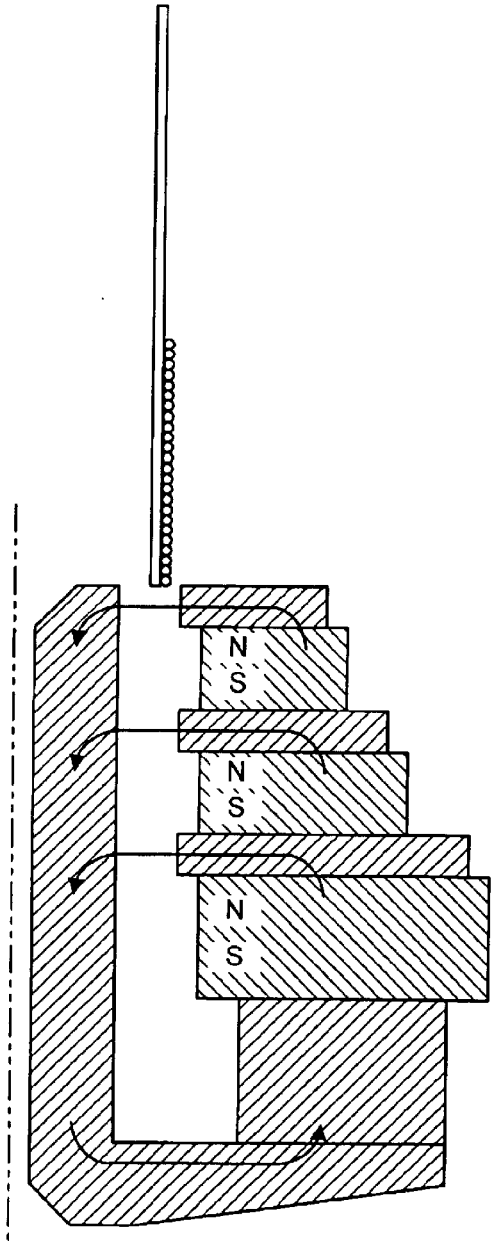

This configuration has the equivalent of two magnetic air gaps—66% of the total—active over the entire linear excursion. In FIG. 5A, the middle magnetic air gap is active, and one half of each of the top and bottom magnetic air gaps are active. FIG. 5B illustrates the diaphragm assembly at its most extended linear excursion position, in which the bottom of the voice coil is even with the bottom of the middle magnetic air gap; the top and middle magnetic air gaps are active, and the bottom magnetic air gap is inactive.

As the voice coil continues to extend outward, the middle magnetic air gap progressively becomes inactive. However, because the top magnetic air gap is still active, the speaker does not immediately exhibit high distortion. Instead, one full magnetic air gap (the top one) remains fully active until the position shown in FIG. 5C, where the bottom of the voice coil encounters the bottom of the top magnetic air gap. Only after that point, as the voice coil continues extending outward, does the electromotive drive of the speaker trail off toward zero, at the point shown in FIG. 5D, where the bottom of the voice coil has left the top edge of the top magnetic air gap.

Figure 5E:
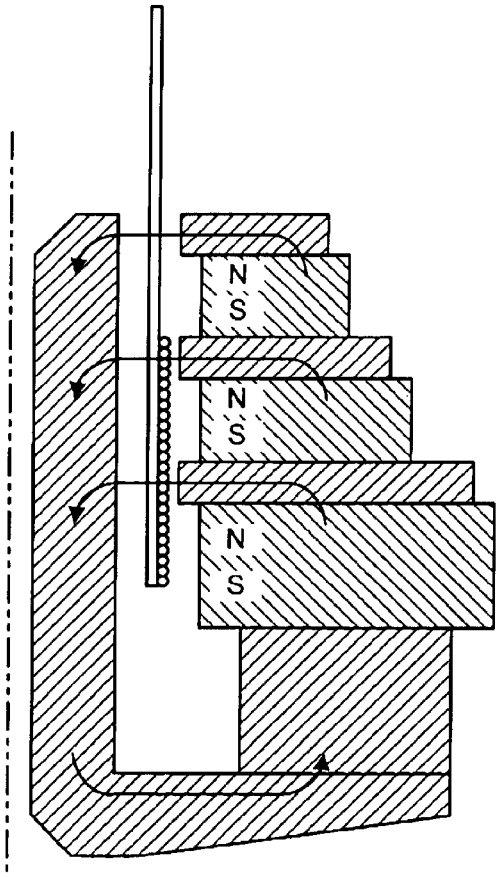
Figure 5F:
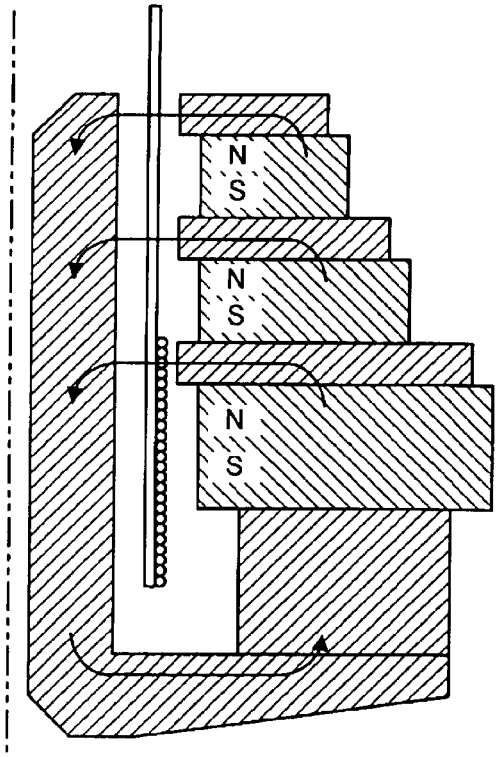

Going in the other direction from the centered position of FIG. 5A, FIG. 5E illustrates the other end of the linear excursion, where the top of the voice coil encounters the top of the middle magnetic air gap. Then, as the voice coil continues withdrawing, the middle magnetic air gap progressively becomes inactive, but the bottom magnetic air gap remains fully active until the position shown in FIG. 5F, where the top of the voice coil encounters the top of the bottom magnetic air gap. As the voice coil then continues withdrawing, the speaker electromotive drive will approach zero when the voice coil completely leaves the bottom magnetic air gap. FIG. 5F clearly demonstrates the purpose of the spacer between the bottom magnet and the pole plate, which is to provide enough space between the bottom magnetic air gap and the pole plate such that the voice coil and bobbin do not strike the pole plate.

This geometry provides good sound quality over an extended dynamic range, due to its stepped function in which there are, in effect, two levels of linear excursion: a center travel region in which two magnetic air gaps are active, and an outer region on either end of this center region, in which one magnetic air gap is active.

Figure 6:
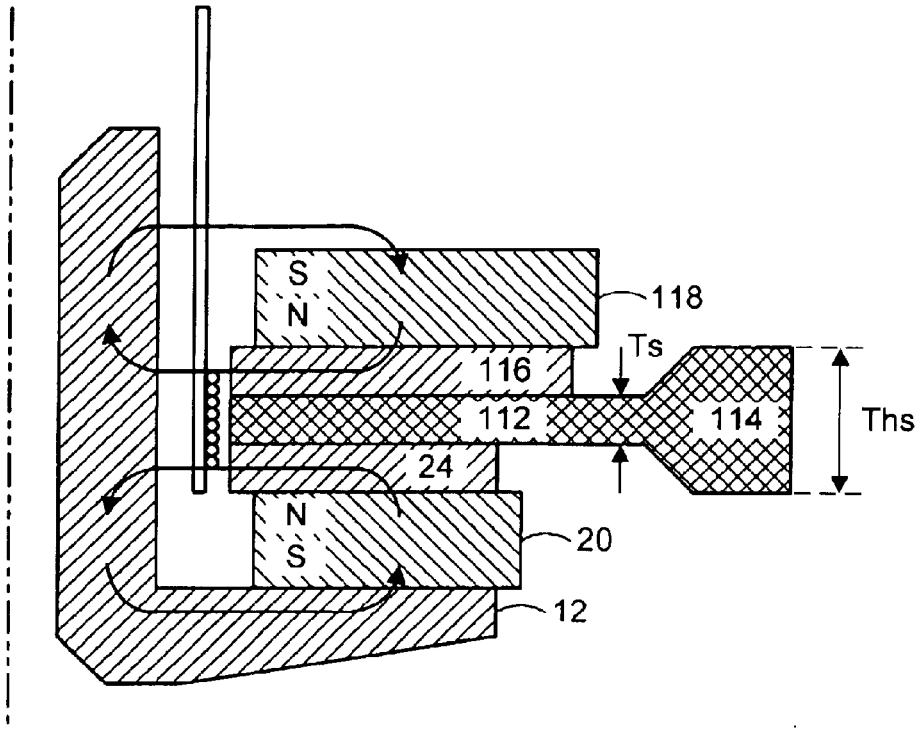
FIG. 6 shows, in cross-section, a fifth embodiment of a speaker geometry, having a cooling device built into the magnet assembly, with two air gaps and one voice coil.

FIG. 6 illustrates a fifth embodiment of a speaker geometry 110 according to this invention. The speaker includes a pole plate 12, first magnet 20, first plate 24, and diaphragm assembly as in the first embodiment. The speaker further includes a heatsink plate 112 which is made of a non-magnetically conductive and, ideally, highly thermally conductive, material such as aluminum. The heatsink plate may advantageously be equipped with a thermal dissipator portion 114 which, in some embodiments, may have a thickness Ths which is substantially greater than the thickness Tsp of the central portion of the heatsink plate. In such embodiments, the overall diameter of the heatsink plate should be sufficiently greater than those of the surrounding components to allow adequate clearance for the thicker heatsink perimeter. Although not illustrated in this cross-section, the heatsink may include axial or radial slots or fins to increase surface area and improve thermal transfer.

The speaker further includes a second plate 116 and a second permanent magnet 118. In this configuration, the second magnet is oriented opposite to the first magnet, so the magnetic flux across the two air gaps is in the same direction, enabling the use of a single voice coil or multiple voice coils generating the same electromagnetic polarity.

Figure 7:
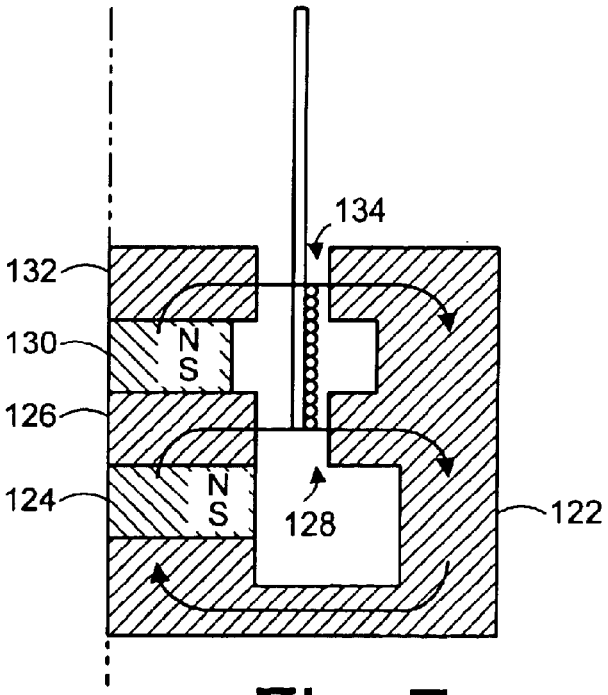
FIG. 7 shows, in cross-section, a sixth embodiment of a speaker geometry, using internal magnets, two air gaps, and one voice coil.

FIG. 7 illustrates a sixth embodiment of a speaker geometry 120 which utilizes internal magnets and plates rather than external ring magnets and plates. Typically, this is the geometry that is employed with neodymium-iron-boron magnets or other rare earth magnets. In this embodiment, the magnetic return path is via an outer perimeter of a yoke or cup 122 rather than via a pole piece. Within the cup are housed an internal magnet 124, a first plate 126 which defines a first magnetic air gap 128, a magnetic material member 130 which may be a permanent magnet or merely a ferrous spacer, and a second plate 132 which defines a second magnetic air gap 134. The bobbin may be equipped with one or more voice coils generating the same polarity and sized as indicated above. In the optimum case, the magnet or spacer 130 may be sized (in diameter) such that the magnetic flux over the top magnetic air gap is substantially the same as the magnetic flux over the bottom air magnetic gap. In some embodiments, the magnet or spacer 130 may be ring shaped. In some embodiments, the top magnet is the same diameter as the bottom magnet, but is made of weaker magnetic material.

In some embodiments, holes (not shown) may be provided through the cup and/or plates and/or magnets to provide air flow to both cool and depressurize the assembly when the voice coil and diaphragm are in heavy movement. In some embodiments, this may be accomplished with one central hole, in an internal ring magnet configuration.

Figure 8:
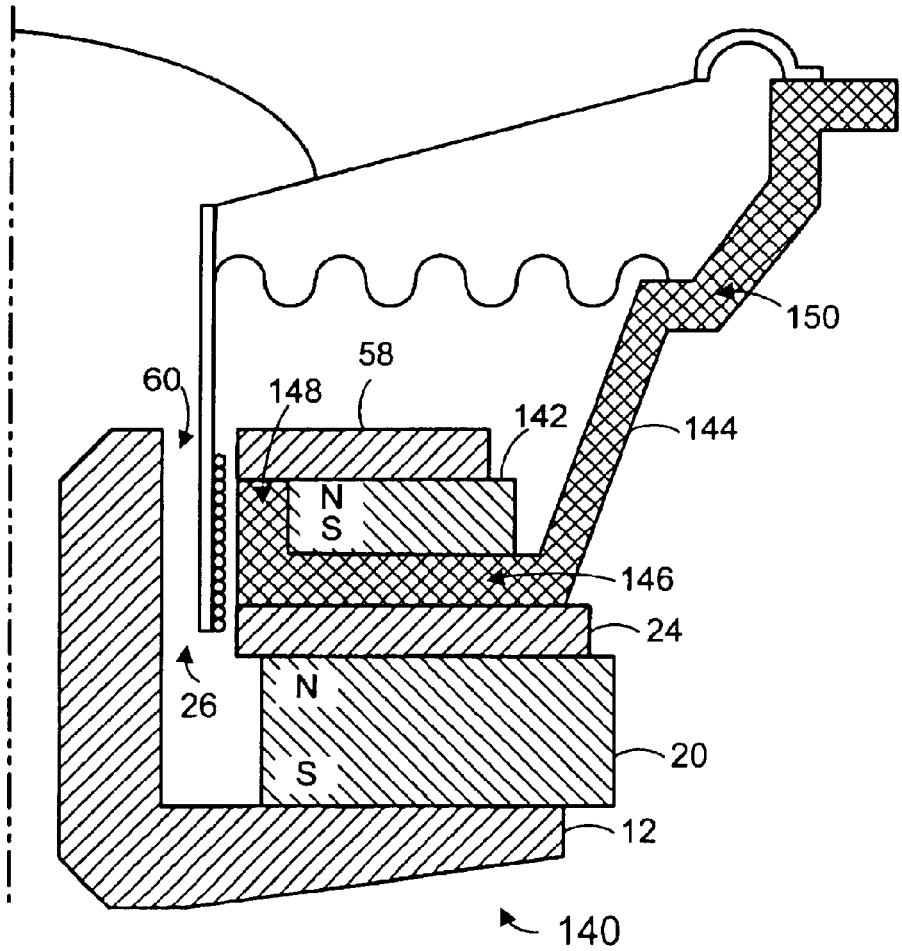
FIG. 8 shows, in cross-section, a seventh embodiment of a speaker geometry, with a unified frame and heatsink.

FIG. 8 illustrates a seventh embodiment of the invention, which is similar to those of FIGS. 2 and 6. The speaker 140 includes a pole plate 12, primary magnet 20, first magnetic air gap plate 24, and second magnetic air gap plate 58, as before. The top magnet 142 has an enlarged inner diameter to accommodate a combined frame and heatsink 144. The heatsink-frame 144 is made of a non-magnetically conductive material, such as aluminum, and includes a portion 146 which is disposed between the first plate and the top magnet, a portion 148 which is disposed within the enlarged inner diameter of the upper magnetic material member such that an enlarged surface area of the heatsink is exposed to the section of the voice coil spanning between the air gaps, and a portion 150 which serves as the frame to support the diaphragm assembly. In some embodiments, the inner surface of the heatsink portion 148 is substantially aligned with, or slightly recessed from, the inner diameters of the two plates.

Figure 9:
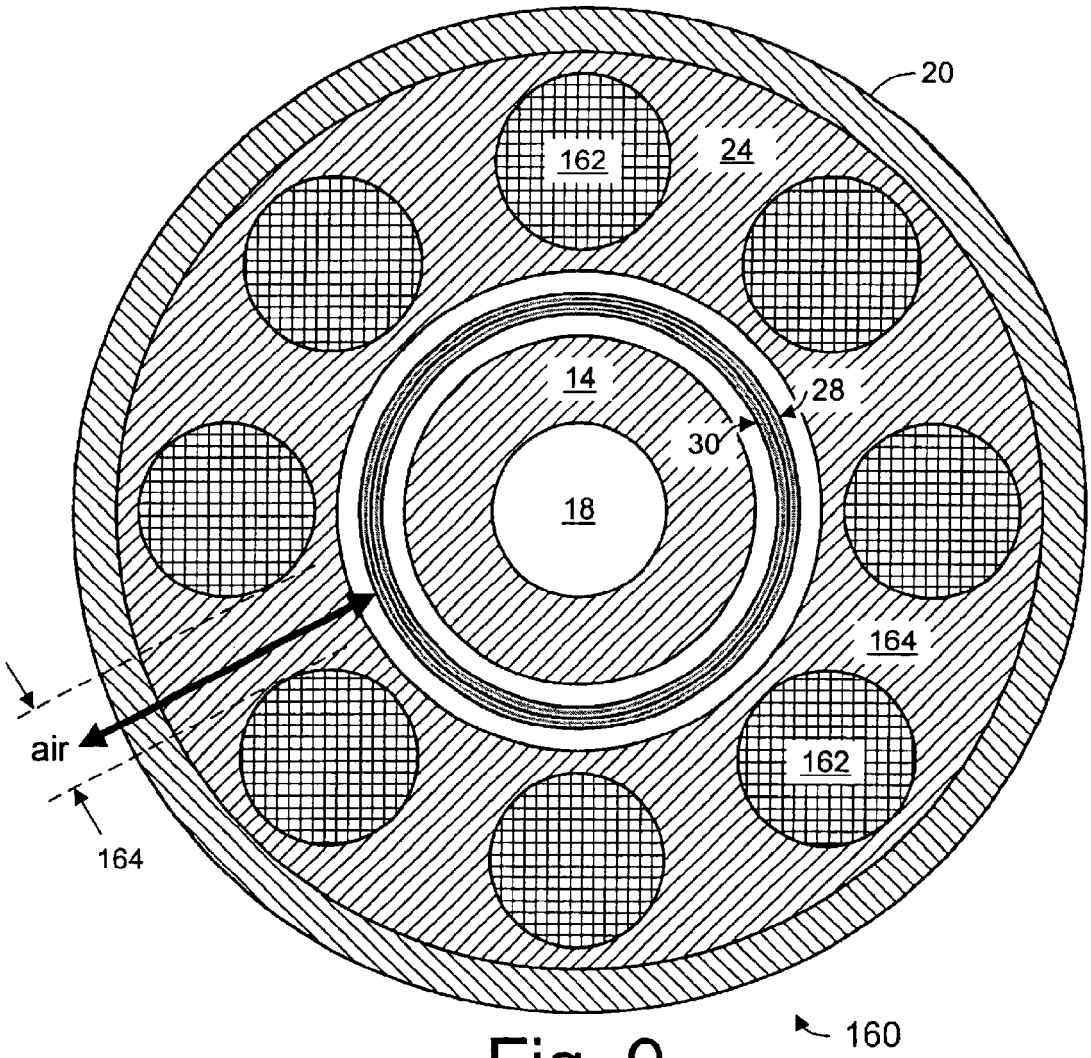
FIG. 9 shows, in top view, an eighth embodiment of a speaker geometry, in which the upper magnet is comprised of a plurality of smaller magnets having spaces between them to permit airflow to cool the voice coil.

FIG. 9 illustrates an alternative embodiment which may optionally be practiced in combination with other principles taught herein. Portions of a motor assembly 160 are shown in top view. From the top, the pole piece 14 is visible, with its optional air vent hole 18. The bobbin 30 and voice coil 28 are seen in cross-section when viewed from above. The bottom, primary magnet 20 is visible and disposed about the pole piece. The first plate 24 is disposed about the pole piece, and is magnetically coupled to the bottom magnet. The second plate is not shown, so that the reader can see the multiple top magnetic material members 162 which are disposed about the axis of the motor. Spaces 164 exist between adjacent top magnetic material members, to permit airflow in and out of the motor structure, to improve cooling. In some embodiments, the motor structure may include a screen or mesh (not shown) to prevent foreign particles from entering into the motor through the spaces between the top magnets. The top magnets 162 have their magnetic poles aligned such that e.g. their North poles are facing out of the page. The skilled reader will appreciate that the top magnets are not necessarily of a round disc shape, and that other shapes, with or without holes, will offer different advantages. For example, a set of wedge-shaped top magnets will offer increased surface area and increased magnetic flux across the top magnetic air gap (not shown).

The total linear excursion in single voice coil embodiments of a speaker according to the principles taught in this patent is substantially equal to:

$$((NG-K+1)*HS)+((NS-K+1)*HG)$$

where K is the number of magnetic air gaps which the voice coil can have active at a time, NG is the number of magnetic air gaps, NS is the number of spaces between the magnetic air gaps (or, in other words, NG−1), HG is the height of a magnetic air gap, and HS is the height of the space between adjacent magnetic air gaps, as long as K is less than NG.

Figure 10:
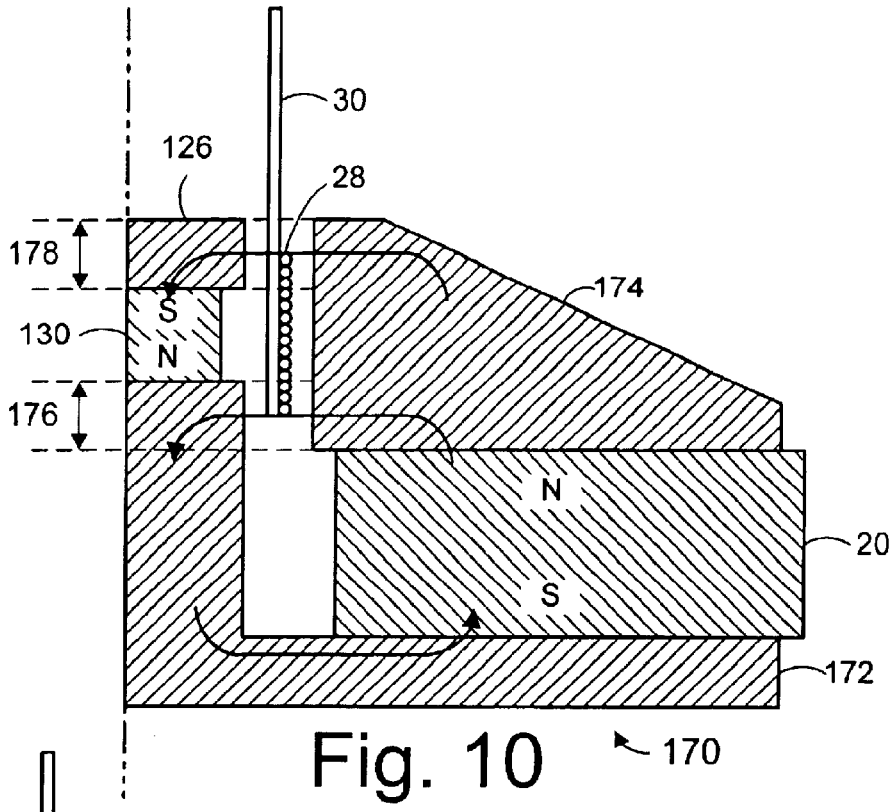
FIG. 10 shows, in cross-section, a ninth embodiment of a speaker geometry using a combination of an external ring magnet as the primary magnet and an internal disc magnet for the upper magnetic air gap.

FIG. 10 illustrates a ninth embodiment of a dual-gap speaker 170 using a hybrid geometry. The speaker includes a pole plate 172 and a primary magnet 20 which is an external ring magnet. An annular external top plate or return path member 174 is magnetically coupled to the primary magnet and defines a bottom magnetic air gap 176 between the annular external top plate and the pole piece of the pole plate. An internal top magnet 130, which may be a disc magnet, is magnetically coupled to the top of the pole piece, and has its magnetic poles oriented opposite those of the primary magnet with respect to the axis of the speaker. An internal top plate 126 is magnetically coupled to the internal top magnet. The top magnetic air gap 178 is defined between the annular external top plate and the internal top plate. Magnetic flux over the two magnetic air gaps is in the same direction with respect to the pole piece or magnetic return path member. A voice coil 28 and bobbin 30 assembly rides in the magnetic air gaps.

Figure 11:
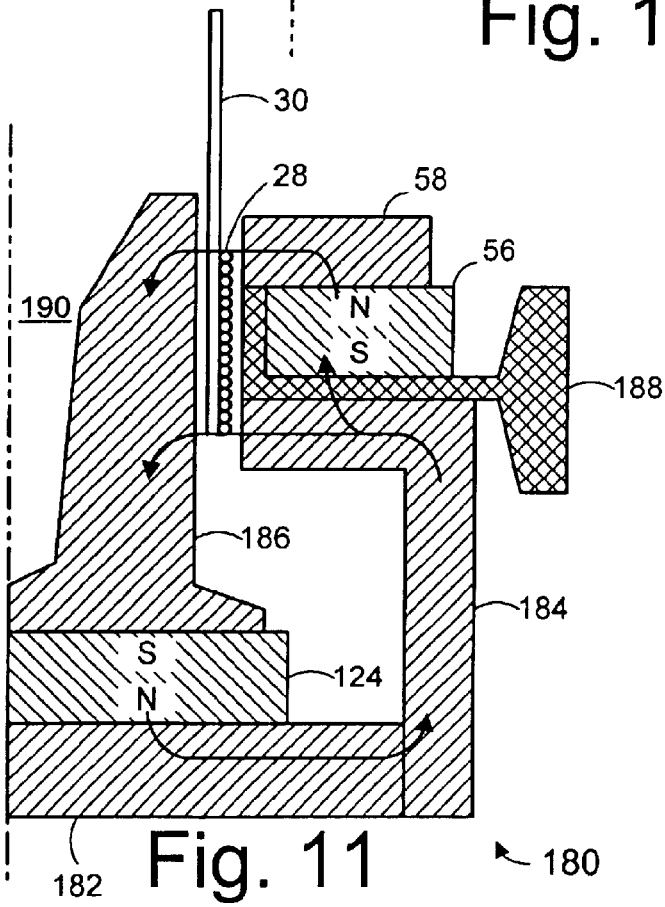
FIG. 11 shows, in cross-section, a tenth embodiment of a speaker geometry using an internal disc magnet as the primary magnet and an external ring magnet for the upper magnetic air gap.

FIG. 11 illustrates a tenth embodiment of a dual-gap speaker 180 using a different hybrid geometry. The speaker includes a cup which may include a back plate 182 and a side wall member 184, or it can be a monolithic structure. An internal magnet 124, which may be a disc magnet, is the primary magnet and is magnetically coupled to the cup. An extended internal top plate member 186, which may alternatively be considered as a pole piece, is magnetically coupled to the primary magnet. An external ring top magnet 56 is magnetically coupled to the cup, optionally over a non-magnetically conductive heatsink 188, and has its magnetic poles oriented opposite those of the primary internal magnet, with respect to the axis of the speaker. An external top plate 58 is magnetically coupled to the external top magnet. The pole piece 186 defines a bottom magnetic air gap between itself and the cup, and a top magnetic air gap between itself and the external top plate. Optionally, the pole piece may be adapted with a hole 190 for reducing its weight and improving cooling of the motor structure. In some embodiments, the hole can extend through the pole piece, the internal primary magnet (which is, then, a ring magnet), and the cup. A voice coil 28 and bobbin 30 assembly rides in the magnetic air gaps.

RETURN PATH

Figure 12:
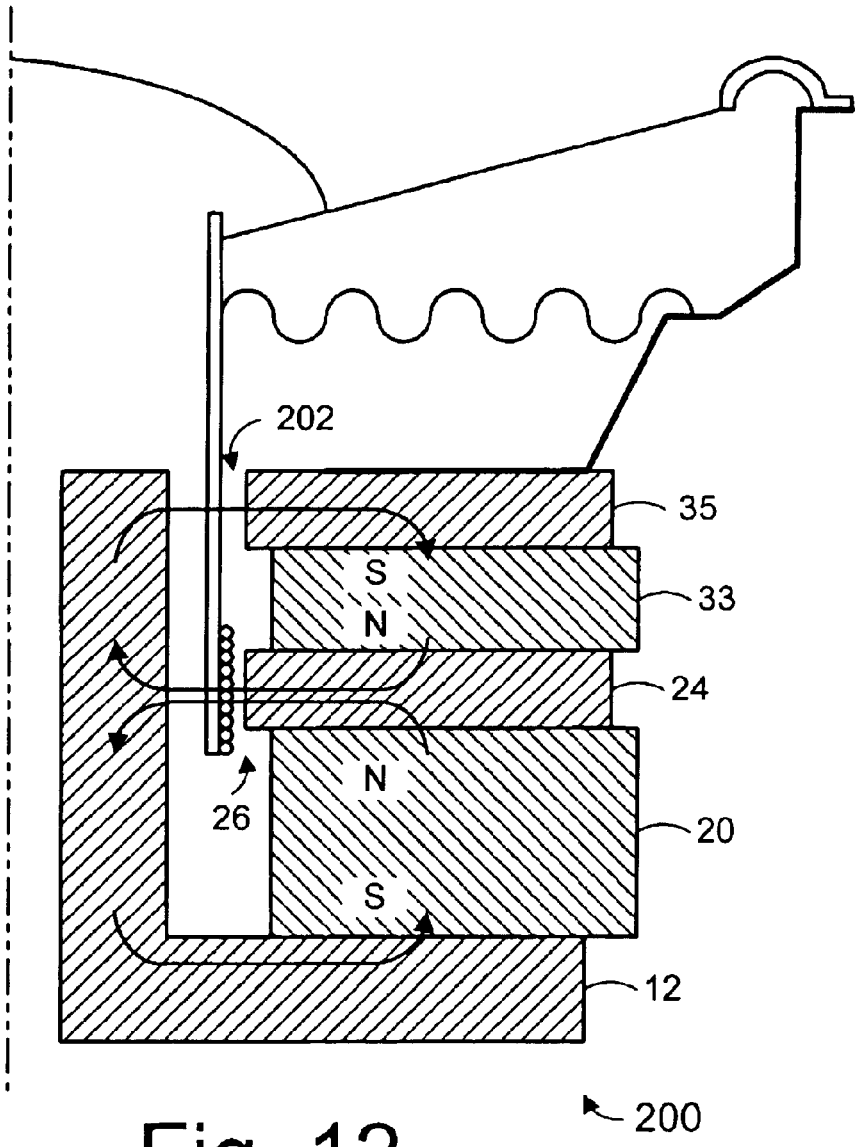
FIG. 12 shows, in cross-section, one embodiment of an external magnet geometry speaker using a bucking magnet with low reluctance return path, according to this invention.

FIG. 12 illustrates one embodiment of a speaker 200 according to this invention. The diaphragm assembly may be substantially unaltered from that illustrated above. The magnet assembly of the speaker includes a pole plate, a primary magnet 20, a primary plate 24, and a bucking magnet 33 as in the prior art. The bucking magnetic air gap 202 defined by the bucking plate or low reluctance return path plate 35 is not a drive magnetic air gap, and no voice coil is present in it. Rather, the magnetic air gap 202 is a low reluctance return path for the magnetic flux from the drive plate 24 to the bucking magnet 33 over the bucking plate 35. This second magnetic air gap, which has its magnetic flux in the opposite direction to that of the primary or drive magnetic air gap 26, serves not only to increase the magnetic flux over the drive magnetic air gap (by providing a low reluctance return path for the bucking magnet), but also provides braking action to reduce over-extension of the diaphragm assembly. In normal operation, the diaphragm assembly is electromagnetically inert in the low reluctance return path magnetic air gap; however, under conditions of extreme excursion, the voice coil may enter the bucking magnetic air gap, which will result in braking action due to the flux over the bucking air gap being in the opposite direction from that of the drive air gap(s). In some embodiments, the bucking magnet may be made smaller than the primary drive magnet.

The bucking plate may also be termed a return path plate.

Figure 13:
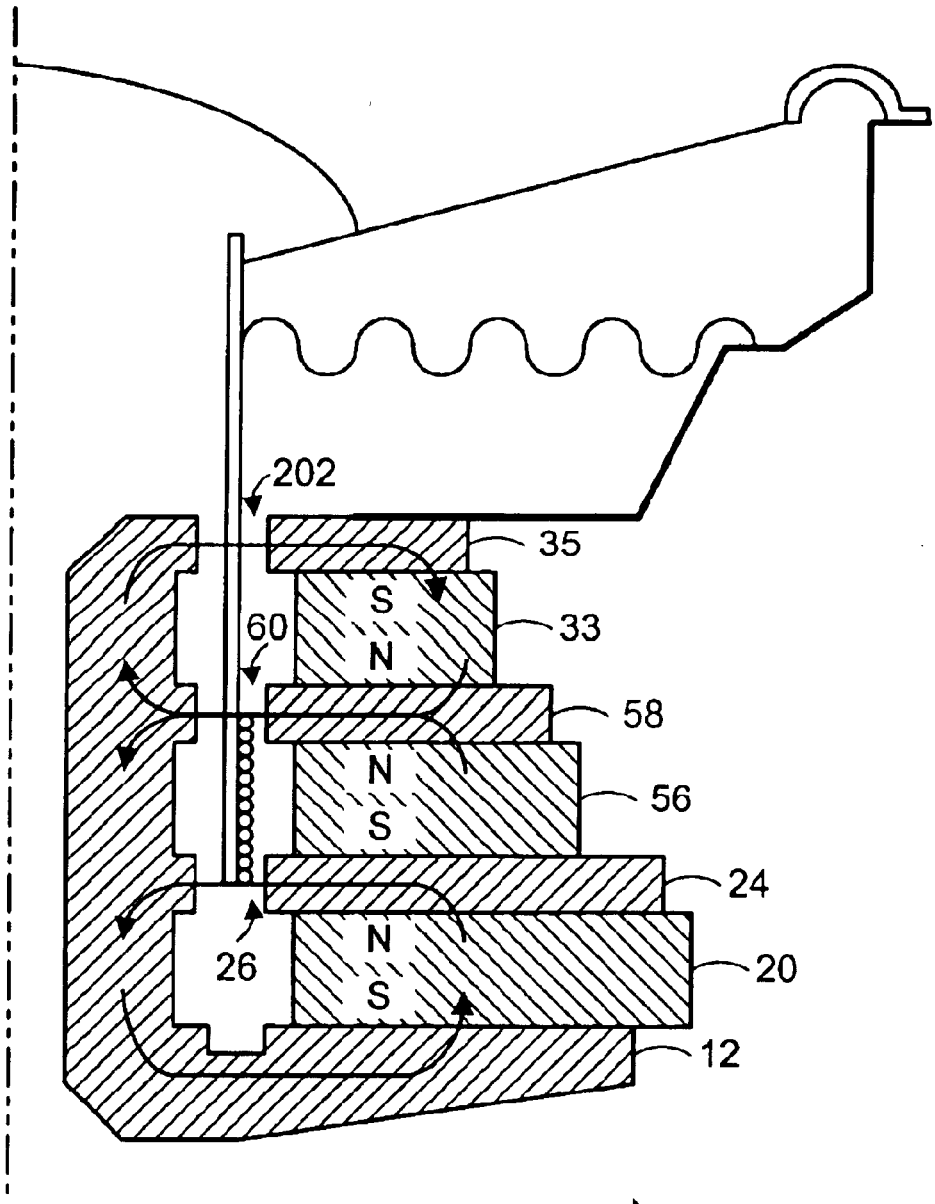
FIG. 13 shows, in cross-section, another embodiment of the invention in which there are multiple drive magnetic air gaps.

FIG. 13 illustrates another embodiment of a speaker 210 according to this invention, in which the speaker includes a dual magnetic air gap geometry similar to that of FIG. 2A. The speaker includes a pole plate 12, a primary magnet 20, a primary plate 24 with its magnetic air gap 26, a bucking magnet 33, and a bucking plate 35 with its magnetic air gap 202. The speaker further includes a second magnet or magnetic material member 56 oriented in the same polarity as the primary magnet and positioned between the primary plate and the bucking magnet, and a second drive plate 58 which creates a second drive magnetic air gap 60 with its flux in the same direction as the flux over the primary drive magnetic air gap. This geometry provides the advantages of the dual magnetic air gap, such as increased linear excursion, plus the advantages of the bucking plate. The bucking plate can serve not only to increase the flux density over its neighboring drive gap, but also to reduce or avoid magnetic saturation in the return path member (pole piece or cup). In some multiple drive magnetic air gap embodiments, there may be a single voice coil, as shown, or there may be multiple voice coils (which may be wound in the same direction and driven in-phase, or wound in opposite directions and driven out of phase). In some embodiments, the second magnet may be replaced with a spacer.

Figure 14:
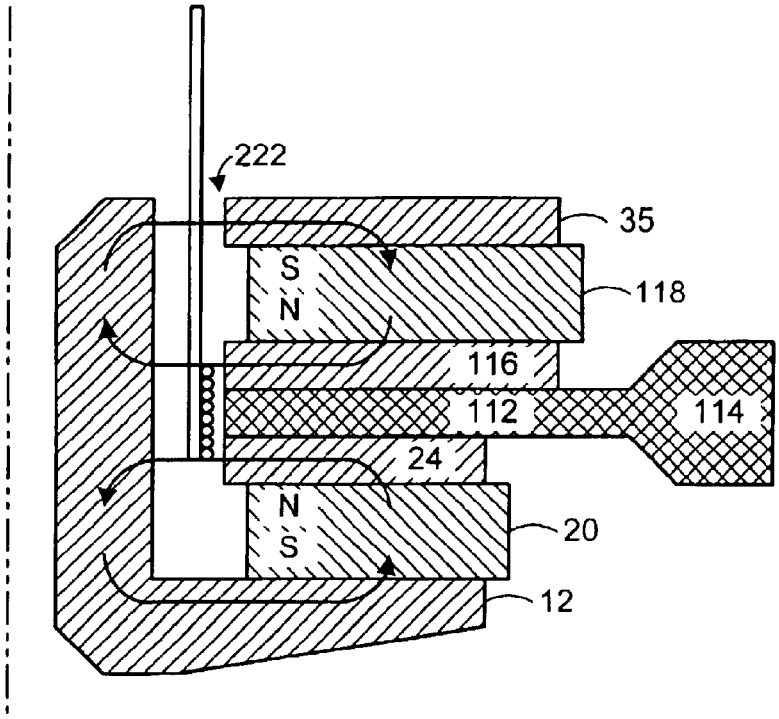
FIG. 14 shows, in cross-section, another embodiment in which there is a heatsink.

FIG. 14 illustrates a speaker 220 similar to that of FIG. 6, with the addition of a return path plate 35 which provides a low reluctance return path over a non-driving magnetic air gap 222 to the top magnet 118.

Figure 15:
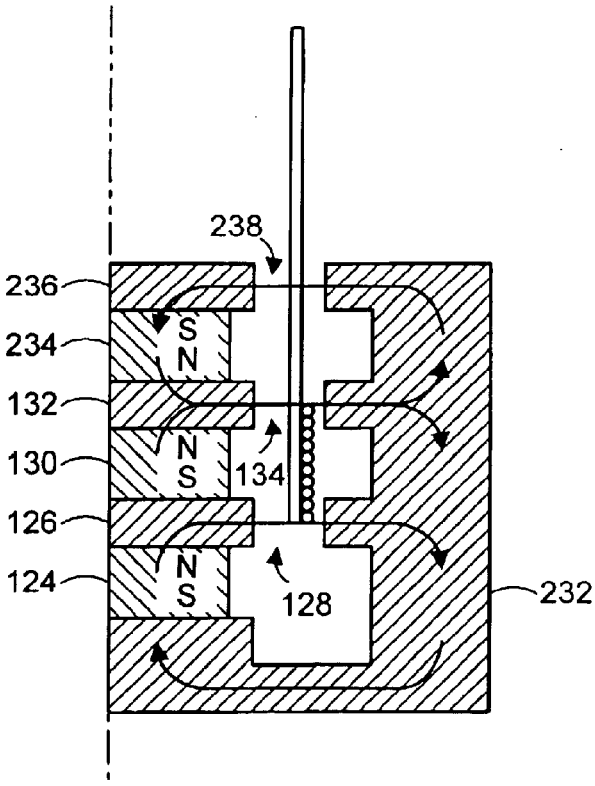
FIG. 15 shows, in cross-section, an internal magnet geometry speaker, according to this invention.

FIG. 15 illustrates another embodiment of an internal magnet geometry speaker 230 similar to that of FIG. 7. The speaker includes a magnetically conductive cup 232, a first drive magnet 124, and a first drive plate 126 which defines a first magnetic air gap 128 between the first drive plate and the cup. The speaker may further include a second drive magnet 130 and a second drive plate 132 which defines a second drive magnetic air gap 134. Alternatively, the component 130 can be a non-magnetically conductive spacer, in which case the upper magnet 234 provides substantially all of the magnetic flux for the upper drive magnetic air gap 134. The two (or more) drive magnets are oriented in the same polarity, such that their magnetic flux is in the same direction over the two (or more) respective drive magnetic air gaps.

The cup may be a monolithic structure, as shown, or it may be formed by coupling separate back and side members. In most embodiments, it will be found advantageous to have the bucking plate disposed within the cup. In other embodiments, it may be acceptable to dispose the bucking plate slightly outside (above) the cup, albeit with a tradeoff in the efficiency of the return path.

Figure 16:
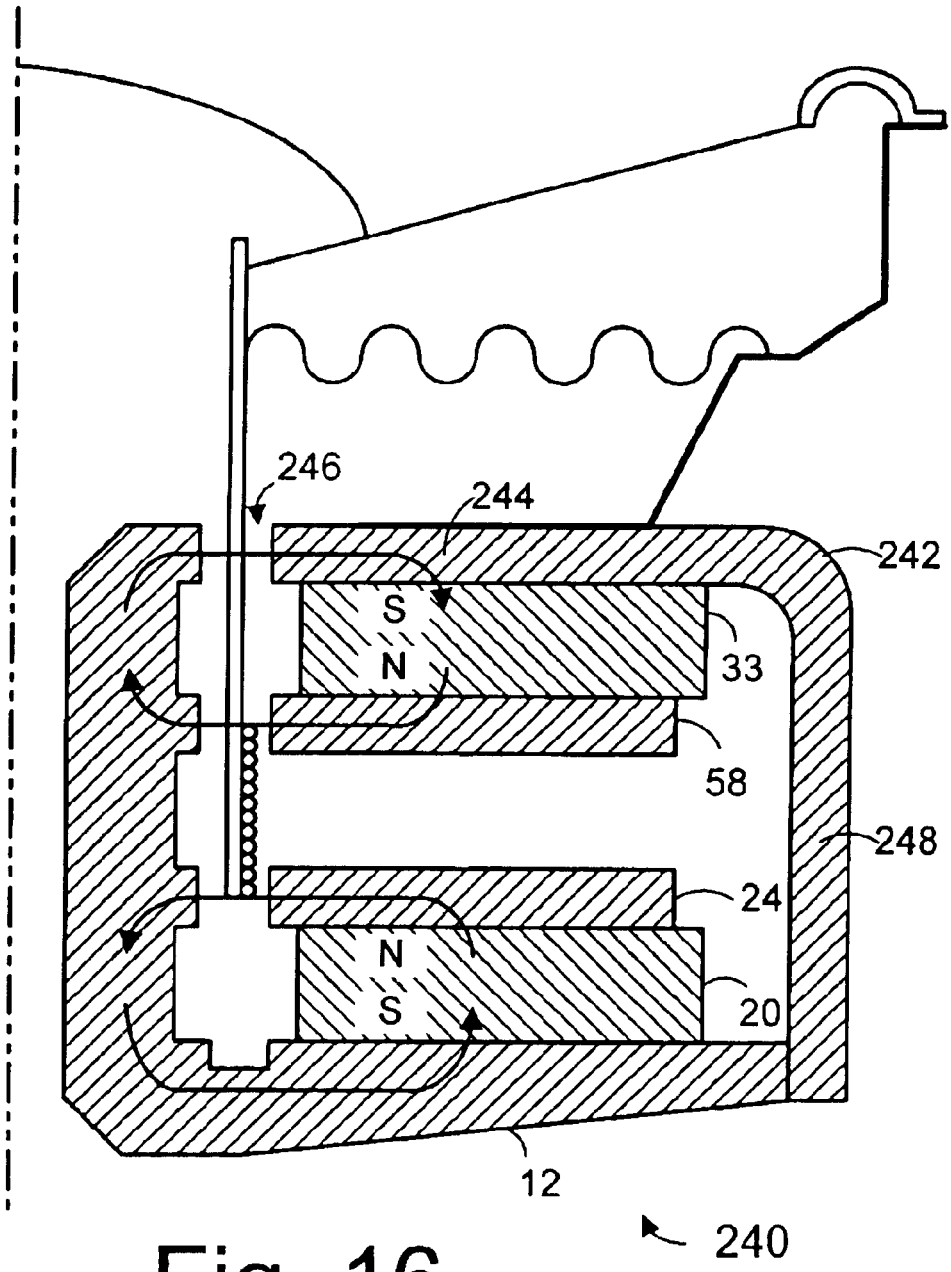
FIG. 16 shows, in cross-section, a shielded external magnet geometry speaker, according to this invention.

FIG. 16 illustrates another embodiment of an external magnet geometry speaker 240 which includes a pole plate 12, a primary drive magnet 20, a first drive plate 24, a bucking magnet 33, and a second drive plate 58 as in FIG. 13. The speaker is shielded by the addition of a magnetically conductive shield 242 which is coupled to the pole plate. The shield includes a plate portion 244 which defines a low reluctance air gap return path 246 for the bucking magnet, and a cylinder portion 248 which is magnetically coupled to the pole plate. In various alternative embodiments, the plate portion and the cylinder portion can be coupled to each other, or formed as a monolithic unit. In other embodiments, the cylinder portion could be formed as an integral portion of the pole plate. In some embodiments, a non magnetically conductive spacer (not shown) may be disposed between the first and second drive plates to help hold them in position; in some such embodiments, the spacer may contact the cylinder portion of the shield to improve thermal transfer away from the drive magnetic air gaps. In some cases, it may be advantageous to assemble the shield, bucking magnet, and second drive plate separately from the rest of the motor assembly, to make it easier to magnetize the respective magnets. It may be advantageous, even in some embodiments where the top magnet and the top drive plate are mechanically coupled to the shield, to provide a non-magnetically conductive spacer (not shown) between the drive plates, to strengthen the overall structure and help prevent the components from moving or coming loose.

Figure 17:
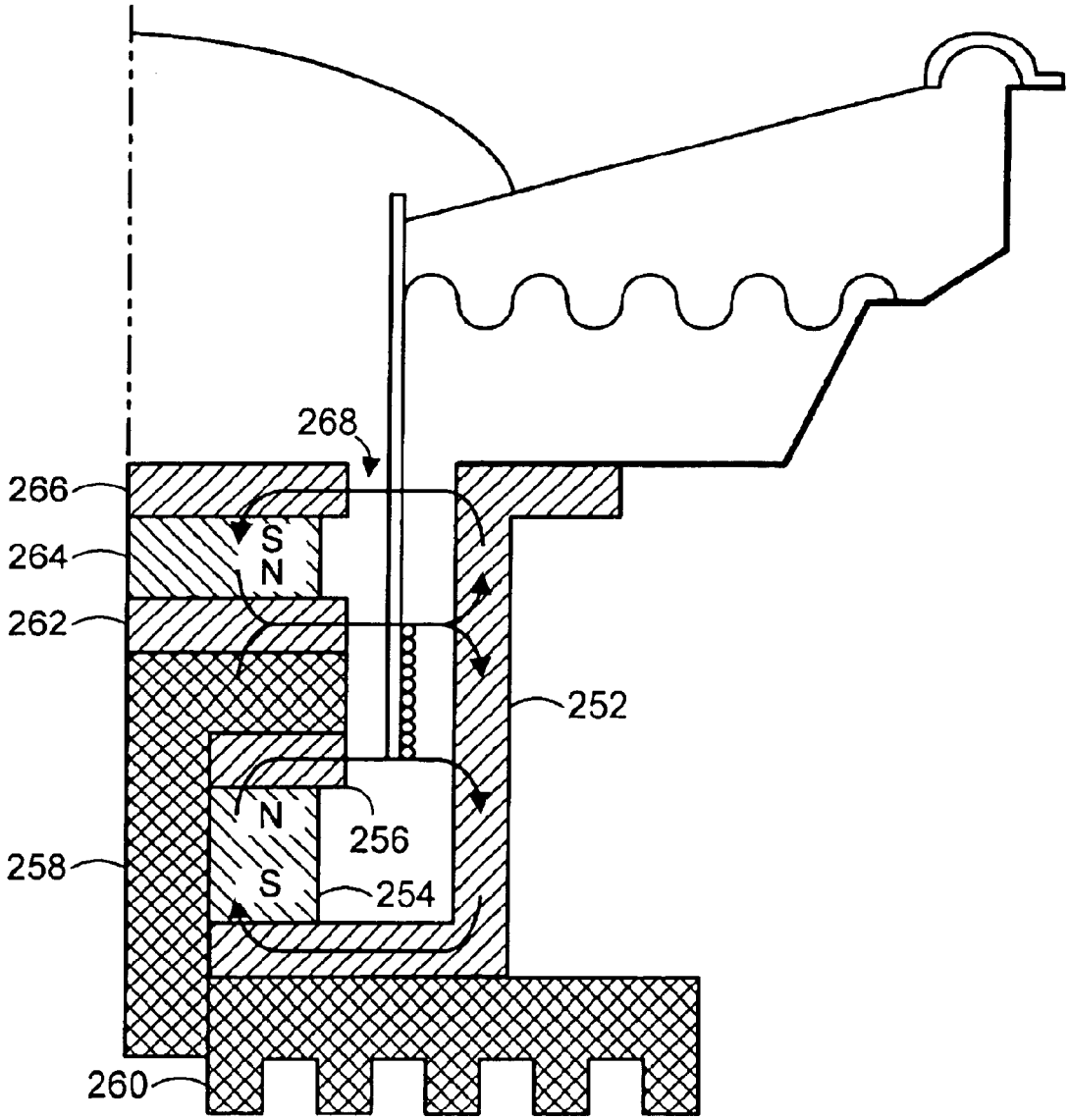
FIG. 17 shows, in cross-section, an internal magnet geometry speaker, with low reluctance bucking magnet return path, multiple drive magnetic air gaps, and heatsink, according to this invention.

FIG. 17 illustrates an internal magnet geometry speaker 250 which is particularly suited for high power applications in which it is necessary to remove significant amounts of heat from the speaker. The speaker includes a cup 252 which encloses a ring-shaped primary drive magnet 254 and a ring-shaped primary drive plate 256 which defines a first drive magnetic air gap, whereas conventional internal magnet geometry speakers would have a disc-shaped magnet and plate. A non magnetically conductive slug 258 or spacer extends through the primary drive plate and primary drive magnet, and is coupled to a heatsink 260 which is external to the motor or magnet assembly. In some embodiments, the heatsink may also be in thermal contact with the cup (as shown). Depending upon the relative strengths of the two magnets and the sizes of the various other components, either the top drive plate may get part of its flux from the bottom magnet (as shown), or the bottom drive plate may get part of its flux from the top magnet.

A second drive plate 262 resides in the cup to define a second drive magnetic air gap, and can be disc-shaped or ring-shaped. The second drive plate may be coupled to the top of the slug, such that the thickness of the top portion of the slug determines the distance between the drive magnetic air gaps. A bucking magnet 264 is coupled between the second drive plate and a bucking plate 266. The bucking plate defines a non-driving low reluctance return path 268 from the cup to the bucking magnet. There may be a single voice coil, or each drive magnetic air gap may have its own voice coil. In some embodiments, there may be additional drive plates and magnets (not shown) between the bucking magnet and the slug. The slug and the heatsink may be fashioned of any suitable non magnetically conductive material which has adequate thermal transfer properties, such as aluminum.

Figure 18:
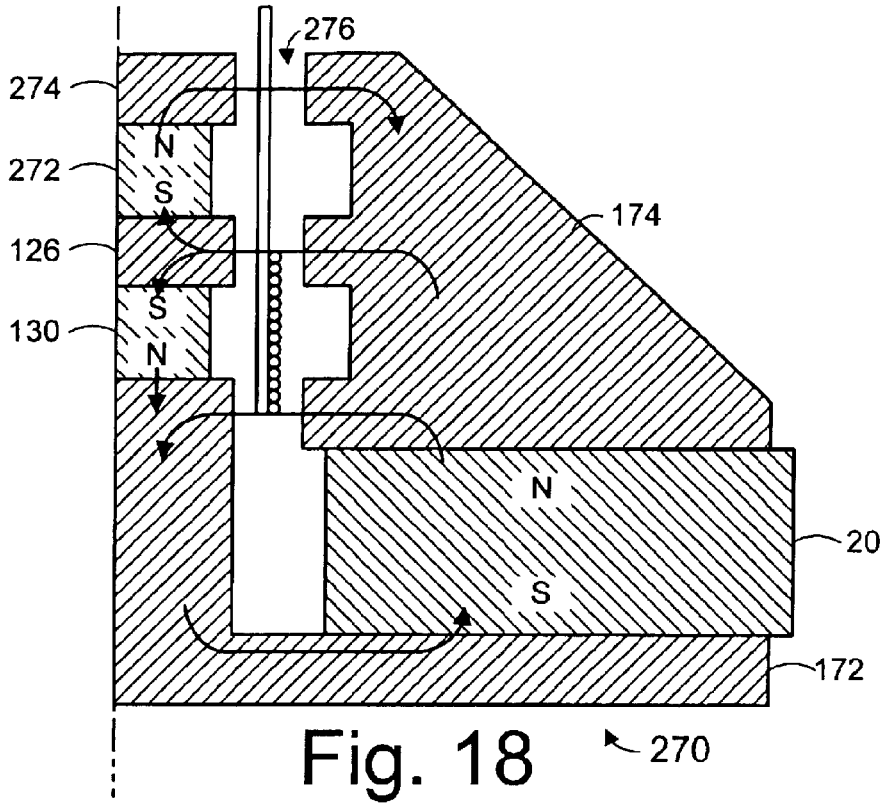
FIG. 18 shows, in cross-section, another embodiment of a hybrid geometry including a low reluctance return path.

FIG. 18 illustrates another embodiment of a hybrid geometry speaker 270 which is similar to that of FIG. 10. The speaker includes an internal bucking magnet 272 which has its polarity opposite that of the internal upper drive magnet 130 and the same as that of the external primary drive magnet 20. In some embodiments, component 130 can be a soft magnetic material, which enables the manufacturer to charge both magnet 20 and magnet 272 at the same time after assembly of the motor. An internal low reluctance return path plate or bucking plate 274 is magnetically coupled to the bucking magnet and defines a non-driving return path magnetic air gap 276 back to the external return path member 174.

Figure 19:
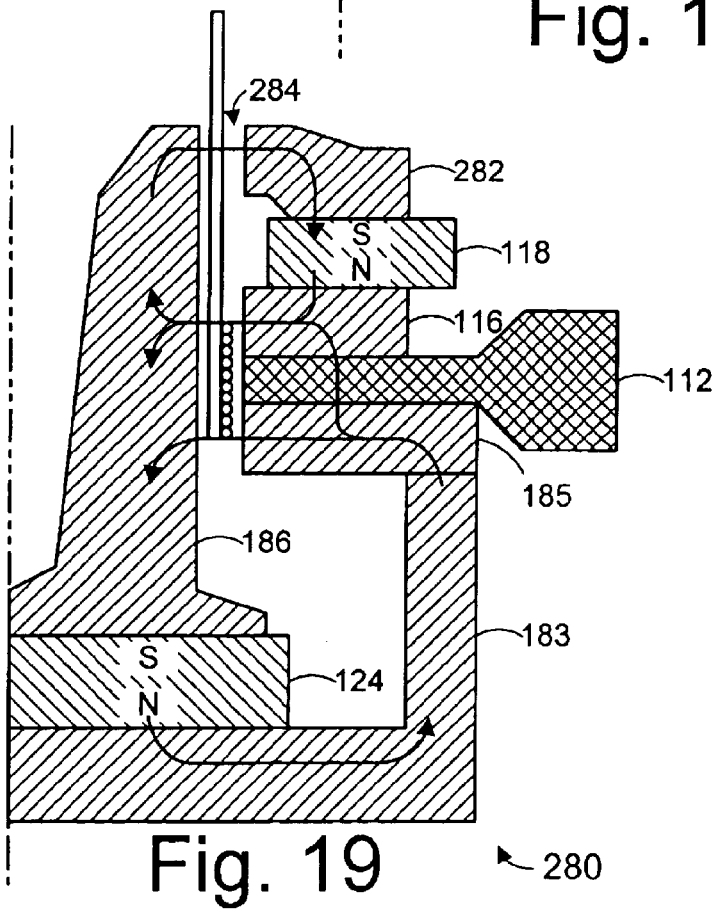
FIG. 19 shows, in cross-section, another embodiment of a hybrid geometry including a low reluctance return path.

FIG. 19 illustrates another embodiment of a hybrid geometry speaker 280 similar to those of FIGS. 11 and 14. The speaker includes a drive plate 185 which is coupled to a cup 183 containing an internal primary drive magnet 124 and internal pole piece 186, and is like the embodiment of FIG. 11 in that the pole piece and cup define the lower drive magnetic air gap. Externally, the speaker includes a heatsink 112, an annular plate 116, and an external bucking magnet 118, and is like the embodiment of FIG. 14 in that the pole piece and the external plate define the upper drive magnetic air gap. Like the embodiment of FIG. 14, this speaker also includes an external return path plate 282 (analogous to plate 35 of FIG. 14) which provides a low reluctance return path for flux from the pole piece to the bucking magnet. The polarities of the internal magnet and the external magnet are in the same direction, which allows for simultaneous charging or magnetization of the magnets. In some embodiments, the heatsink and the frame (not shown) may be one monolithic structure, in which the frame or basket becomes a part of the radiative structure of the heatsink.

Figure 20:
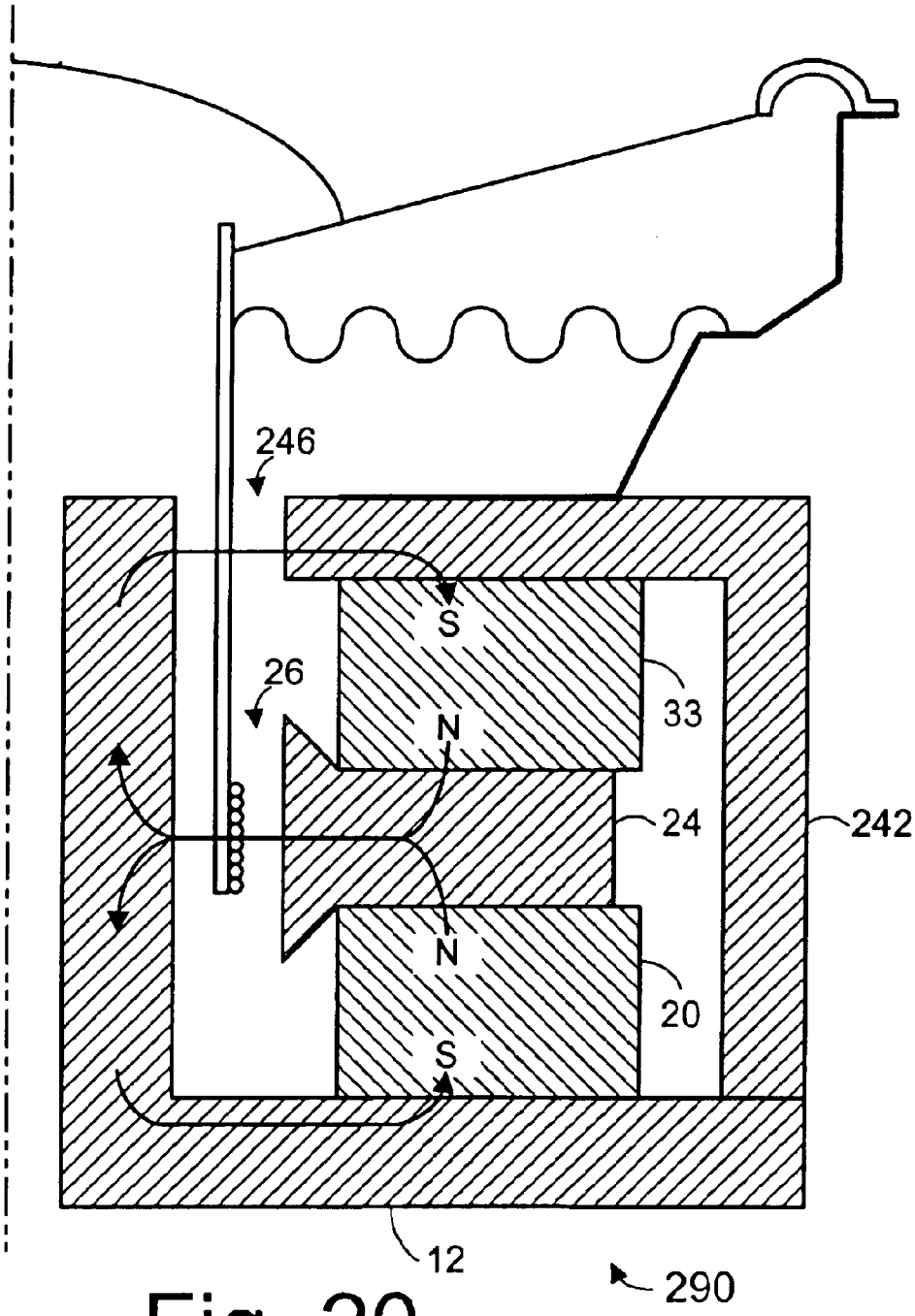
FIG. 20 shows, in cross-section, another external magnet geometry speaker.

FIG. 20 illustrates another embodiment of an external magnet geometry transducer 290 including a pole plate 12, a primary drive magnet 20, a drive plate 24, a bucking magnet 33, and an external shield 242 which is coupled to the pole plate and the bucking magnet. The drive plate has an extended internal margin to facilitate an underhung voice coil in a lengthened drive magnetic air gap 26. A low reluctance return path 246 is provided from the pole piece to the bucking magnet by the non-driving magnetic air gap between the pole piece and the shield.

Figure 21:
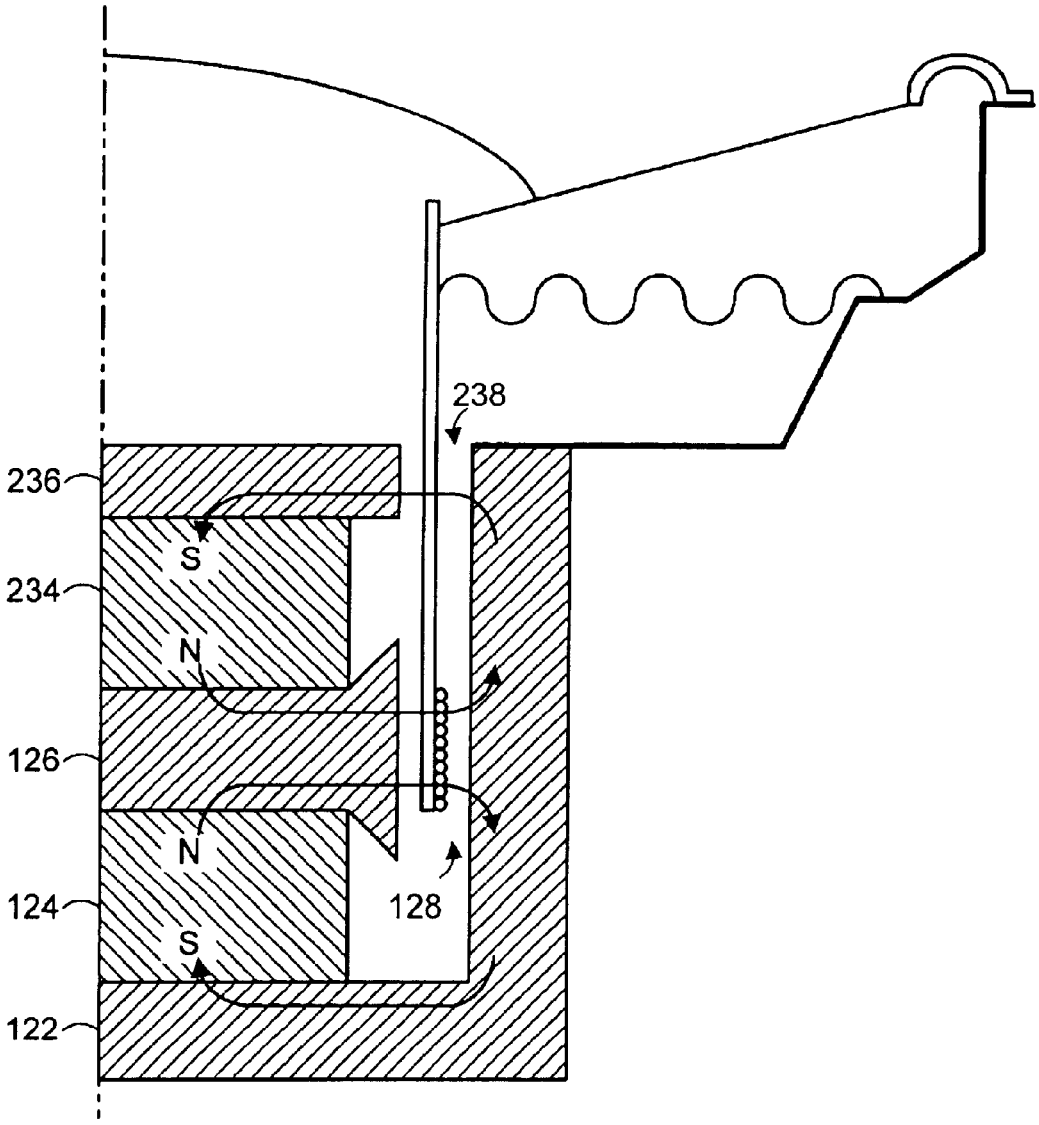
FIG. 21 shows, in cross-section, another internal magnet geometry speaker.

FIG. 21 illustrates another embodiment of an internal magnet geometry transducer 300 including a cup 122, a primary drive magnet 124, a drive plate 126, a bucking magnet 234, and a return path plate 236. The voice coil is active in a drive magnetic air gap 128, and a low reluctance return path 238 is provided by the non-driving magnetic air gap between the cup and the return path plate.

Figure 22:
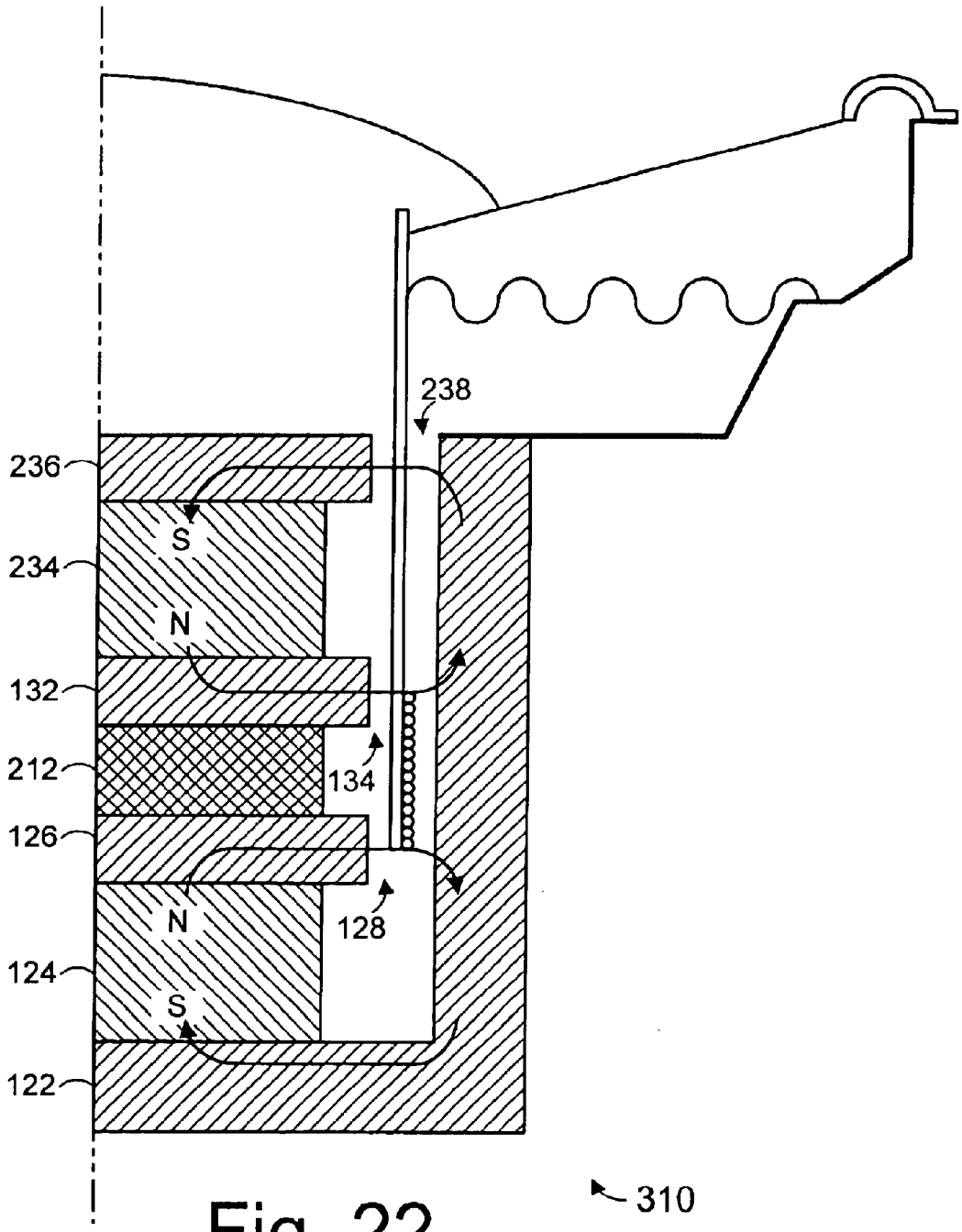
FIG. 22 shows, in cross-section, another internal magnet geometry speaker.

FIG. 22 illustrates another embodiment of an internal magnet geometry transducer 310 which includes a cup 122, a primary drive magnet 124, a lower drive plate 126 which defines a lower drive magnetic air gap 128, a non-magnetically conductive spacer 212, an upper drive plate 132 which defines an upper drive magnetic air gap 134, a bucking magnet 234, and a return path plate 236 which provides a low reluctance return path from the cup to the bucking magnet over a non-driving magnetic air gap 238.

CONCLUSION

Reference in the specification to "an embodiment," "one embodiment," "some embodiments," or "other embodiments" means that a particular feature, structure, or characteristic described in connection with the embodiments is included in at least some embodiments, but not necessarily all embodiments, of the invention. The various appearances "an embodiment," "one embodiment," or "some embodiments" are not necessarily all referring to the same embodiments.

If the specification states a component, feature, structure, or characteristic "may", "might", or "could" be included, that particular component, feature, structure, or characteristic is not required to be included. If the specification or claim refers to "a" or "an" element, that does not mean there is only one of the element. If the specification or claims refer to "an additional" element, that does not preclude there being more than one of the additional element.

In the claims, the phrase "magnetically coupled to" is intended to mean "in magnetic communication with" or in other words "in a magnetic flux circuit with", and not "mechanically affixed to by means of magnetic attraction." In the claims, the phrase "air gap" is intended to mean "gap over which magnetic flux is concentrated" and not limited to the case where such gap is actually filled with air; the gap could, in some applications, be filled with any suitable gas or liquid such as magnetic fluid, or even be under vacuum.

When one component is said to be "adjacent" another component, it should not be interpreted to mean that there is absolutely nothing between the two components, only that they are in the order indicated.

The several features illustrated in the various figures may be combined in many ways, and should not be interpreted as though limited to the specific embodiments in which they were explained and shown.

Those skilled in the art having the benefit of this disclosure will appreciate that many other variations from the foregoing description and drawings may be made within the scope of the present invention. Indeed, the invention is not limited to the details described above. Rather, it is the following claims including any amendments thereto that define the scope of the invention.

What is claimed is:

1. An electromagnetic transducer comprising:

first magnetic motor components defining at least two drive magnetic air gaps each having magnetic flux oriented in a same first direction;

second magnetic motor components defining a non-driving magnetic air gap having magnetic flux oriented in a second direction opposite the first direction and providing a low reluctance return path for one of the drive magnetic air gaps; and a diaphragm assembly including a diaphragm, a bobbin coupled to the diaphragm, at least one voice coil coupled to the bobbin and disposed within at least one of the drive magnetic air gaps, wherein the diaphragm assembly extends through and is electromagnetically substantially inert within the non-driving magnetic air gap.

2. The electromagnetic transducer of claim 1 wherein the first and second components together comprise an external magnet geometry transducer having ring magnets.

3. The electromagnetic transducer of claim 1 wherein the first and second components together comprise an internal magnet geometry transducer.

4. The electromagnetic transducer of claim 1 wherein the first and second components together comprise a hybrid internal/external magnet geometry transducer.

5. The electromagnetic transducer of claim 1 configured as an audio speaker.

6. The electromagnetic transducer of claim 5 configured as a sub-woofer.

7. The electromagnetic transducer of claim 1 configured as a microphone.

8. The electromagnetic transducer of claim 1 configured as a position sensor.

9. The electromagnetic transducer of claim 1 configured as an electromechanical actuator.

10. An electromagnetic transducer comprising:

a pole plate including a pole piece and a back plate;

a first drive plate defining a first drive magnetic air gap between the first drive plate and the pole piece;

a first drive magnet magnetically coupled to, and positioned between, the back plate and the first drive plate;

a magnetic material member magnetically coupled to the first drive plate opposite the first drive magnet;

a second drive plate defining a second drive magnetic air gap between the second drive plate and the pole piece, and disposed between the bucking magnet and the magnetic material member;

a bucking magnet magnetically coupled to the first drive plate and positioned on an opposite side of the first drive plate from the first drive magnet, and having its polarity opposite that of the first drive magnet;

a bucking plate magnetically coupled to the bucking magnet and positioned on an opposite side of the bucking magnet from the first drive plate, and defining a non-driving magnetic air gap to provide a low reluctance return path from the pole piece to the bucking magnet;

a diaphragm assembly including a diaphragm, a bobbin coupled to the diaphragm, a first voice coil coupled to the bobbin and disposed in the first drive magnetic air gap, voice coil windings coupled to the bobbin and disposed in the second drive magnetic air gap, wherein the diaphragm assembly is substantially electromagnetically inert within the non-driving magnetic air gap.

11. The electromagnetic transducer of claim 10 further comprising:

a frame coupled to the bucking plate;

a spider coupled to the frame and to the bobbin; and a surround coupled to the frame and to the diaphragm.

12. The electromagnetic transducer of claim 10 wherein:

the voice coil windings comprise a second voice coil distinct from the first voice coil.

13. The electromagnetic transducer of claim 10 further comprising:

a non magnetically conductive spacer disposed between the second drive plate and the first drive plate.

14. The electromagnetic transducer of claim 13 wherein:

the non magnetically conductive spacer comprises a heatsink.

15. The electromagnetic transducer of claim 14 wherein:

the heatsink comprises aluminum.

16. The electromagnetic transducer of claim 14 wherein:

the heatsink has a diameter larger than diameters of the first drive magnet and the first drive plate.

17. The electromagnetic transducer of claim 10 further comprising:

a second drive magnet disposed between the second drive plate and the first drive plate, and oriented with its polarity the same as that of the first drive magnet.

18. The electromagnetic transducer of claim 17 wherein:

the bucking magnet is smaller than the second drive magnet; and the second drive magnet is smaller than the first drive magnet.

19. The electromagnetic transducer of claim 10 further comprising:

a magnetically conductive shield magnetically coupled to the back plate and the bucking plate.

20. The electromagnetic transducer of claim 19 wherein:

the magnetically conductive shield and the bucking plate comprise a monolithic structure.

21. The electromagnetic transducer of claim 10 wherein:

the pole piece and the back plate comprise distinct components.

22. A electromagnetic transducer comprising:

a cup;

a first drive magnet disposed within and magnetically coupled to the cup;

a first drive plate disposed within the cup and magnetically coupled to the first drive magnet, positioned on an opposite side of the first drive magnet from the cup, and defining a first drive magnetic air gap between the first drive plate and the cup;

a second drive plate disposed within the cup and magnetically coupled to, and positioned between, the bucking magnet and the first drive plate, and defining a second drive magnetic air gap between the second drive plate and the cup;

a bucking magnet disposed within the cup and magnetically coupled to the first drive plate, and having its magnetic polarity opposite that of the first drive magnet;

a bucking plate disposed substantially within the cup and magnetically coupled to the bucking magnet, and disposed on an opposite side of the bucking magnet from the first drive plate, and defining a non-driving magnetic air gap to provide a low reluctance return path from the cup to the bucking magnet; and a diaphragm assembly including a diaphragm, a bobbin coupled to the diaphragm, a first voice coil coupled to the bobbin and disposed in the first drive magnetic air gap, and voice coil windings coupled to the bobbin and disposed in the second drive magnetic air gap, wherein the diaphragm assembly is substantially electromagnetically inert within the non-driving magnetic air gap.

23. The electromagnetic transducer of claim 22 wherein:

the voice coil windings comprise a second voice coil distinct from the first voice coil.

24. The electromagnetic transducer of claim 22 further comprising:

the primary drive magnet and the primary drive plate are substantially ring-shaped;

a non magnetically conductive slug disposed through the primary drive magnet and the primary drive plate; and a second drive plate disposed between the bucking magnet and the primary drive plate, and separated from the primary drive plate by the slug, and defining a second drive magnetic air gap between the second drive plate and the cup.

25. The electromagnetic transducer of claim 24 further comprising:

a heatsink thermally coupled to the slug.

26. The electromagnetic transducer of claim 25 wherein:

the heatsink comprises aluminum.

27. The electromagnetic transducer of claim 25 wherein:

the heatsink is of monolithic construction with a frame; and the electromagnetic transducer further comprises, a spider coupled to the frame and to the bobbin, and a surround coupled to the frame and to the diaphragm.

28. The electromagnetic transducer of claim 22 further comprising:

a second drive magnet disposed within the cup between the second drive plate and the first drive plate.

29. The electromagnetic transducer of claim 22 further comprising:

a frame coupled to the cup;

a spider coupled to the frame and to the bobbin; and a surround coupled to the frame and to the diaphragm.

30. A method of operating an audio speaker, the method comprising:

A) conducting first magnetic flux in a first magnetic circuit i) from a first drive magnet, ii) through a first drive plate, iii) in a first direction across a voice coil disposed within a first drive magnetic air gap, iv) through a magnetically conductive member which comprises one of a cup and a pole plate, and v) back to the first drive magnet;

B) conducting second magnetic flux in a second magnetic circuit i) from a bucking magnet, ii) through a second drive plate, iii) in the first direction across a voice coil disposed within a second drive magnetic air gap, iv) through the magnetically conductive member, v) across a non driving magnetic air gap in a second direction opposite the first direction without passing through a voice coil, vi) through a bucking plate, and vii) back to the bucking magnet; and C) conducting an alternating current electrical signal through the voice coil to move a bobbin coupled to the voice coil, and a diaphragm coupled to the bobbin, by electromagnetic action in the drive magnetic air gap(s) only.

31. The method of claim 30 further comprising:

moving the diaphragm until the voice coil enters the non driving magnetic air gap; and braking the movement of the diaphragm by the voice coil encountering the second direction magnetic flux in the non driving magnetic air gap.

32. The method of claim 30 wherein:

the voice coil recited in A.iii and the voice coil recited in B.iii comprise distinct first and second voice coils.

33. An audio speaker comprising:

(A) a magnetically conductive member;

(B) at least two magnet/plate pairs each including, (i) a drive magnet having its magnetic poles oriented in a first direction with respect to the magnetically conductive member, (ii) a magnetic drive plate magnetically coupled to the drive magnet opposite the magnetically conductive member, and (iii) a magnetic drive air gap defined between the magnetic drive plate and the magnetically conductive member;

wherein (a) the magnet of a bottom-most magnet/plate pair is magnetically coupled to the magnetically conductive member, and (b) the magnet of each magnet/plate pair which is not the bottom-most, is magnetically coupled to the magnetic drive plate of a next lower magnet/plate pair;

(C) a bucking magnet magnetically coupled to a top-most magnetic drive plate opposite the magnet/plate pair(s) and having its magnetic poles oriented in a second direction with respect to the magnetically conductive member, wherein the second direction is substantially opposite the first direction;

(D) a return path plate magnetically coupled to the bucking magnet opposite the magnet/plate pair(s) and defining a non-driving magnetic air gap to provide a low reluctance return path between the bucking magnet and the magnetically conductive member; and (E) a diaphragm assembly mechanically coupled to the magnetically conductive member and including, (i) a diaphragm, (ii) a bobbin coupled to the diaphragm, and (iii) at least one voice coil coupled to the bobbin to reside in the magnetic drive air gap(s) and to stay out of the non-driving magnetic air gap during linear excursion of the diaphragm assembly.

34. The audio speaker of claim 33 wherein the top-most magnetic drive plate is in addition to the magnet/plate pair(s) rather than being the plate of a top-most magnet/plate pair.

35. The audio speaker of claim 33 wherein the magnetically conductive member comprises a cup and the magnet/plate pair(s) are internal to the cup.

36. The audio speaker of claim 33 wherein the magnetically conductive member comprises a pole plate including a pole piece, and the magnet/plate pairs are external to the pole piece.

37. An electromagnetic transducer comprising:

an internal permanent magnet;

at least one internal soft magnet magnetically coupled to the internal permanent magnet;

an external permanent magnet;

at least one external soft magnet magnetically coupled to the external permanent magnet;

at least one drive magnetic air gap defined between one of the internal soft magnet(s) and one of the external soft magnet(s), wherein magnetic flux over each of the drive magnetic air gap(s) is in a same direction;

a low reluctance return path magnetic air gap defined between one of the internal soft magnet(s) and one of the external soft magnet(s), wherein magnetic flux over the low reluctance return path magnetic air gap is in a second direction substantially opposite the first direction; and a voice coil assembly including a bobbin and electrically conductive windings coupled to the bobbin in a position wherein the windings do not enter the low reluctance return path magnetic air gap during linear excursion of the voice coil assembly.

38. The electromagnetic transducer of claim 37 wherein:

the at least one internal soft magnet comprises, a pole plate including a back plate and a pole piece, and a return path plate;

the external permanent magnet is magnetically coupled between the back plate and the external soft magnet;

the internal permanent magnet is magnetically coupled between the return path plate and the pole piece; and the low reluctance return path magnetic air gap is defined between the return path plate and the external soft magnet.

39. The electromagnetic transducer of claim 38 wherein:

the at least one internal soft magnet further comprises an upper drive plate magnetically coupled between the return path plate and the pole piece; and the at least one drive magnetic air gap further comprises an upper magnetic drive air gap defined between the upper drive plate and the external soft magnet.

40. The electromagnetic transducer of claim 39 configured as an audio speaker.

41. The electromagnetic transducer of claim 37 wherein:

the at least one external soft magnet comprises, a cup, a drive plate coupled to the cup, and a return path plate magnetically coupled to the external permanent magnet;

the at least one internal soft magnet comprises a pole piece;

the low reluctance magnetic return path is defined between the return path plate and the pole piece; and the internal permanent magnet is magnetically coupled between the cup and the pole piece.

42. The electromagnetic transducer of claim 41 wherein:

the electromagnetic transducer further comprises an external non-magnetically conductive plate coupled to the drive plate; and the at least one external soft magnet further comprises an upper drive plate coupled between the external non-magnetically conductive plate and the external permanent magnet; and the electromagnetic transducer further comprises an upper magnetic drive air gap defined between the upper drive plate and the pole piece.

43. The electromagnetic transducer of claim 42 configured as an audio speaker.

* * * * *